US008452220B2

(12) United States Patent
Kagawa

(10) Patent No.: US 8,452,220 B2
(45) Date of Patent: May 28, 2013

(54) LASER FIXING DEVICE

(75) Inventor: Toshiaki Kagawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 257 days.

(21) Appl. No.: 12/860,986

(22) Filed: Aug. 23, 2010

(65) Prior Publication Data

US 2011/0058869 A1 Mar. 10, 2011

(30) Foreign Application Priority Data

Sep. 8, 2009 (JP) ..... 2009-207029

(51) Int. Cl.
*G03G 15/20* (2006.01)

(52) U.S. Cl.
USPC ..... 399/336; 399/67; 399/122; 399/320

(58) Field of Classification Search
USPC ..... 399/67, 122, 320, 336
See application file for complete search history.

(56) References Cited

U.S. PATENT DOCUMENTS

| | | | | |
|---|---|---|---|---|
| 6,721,531 | B2 * | 4/2004 | Kishimoto et al. | 399/336 |
| 2009/0097889 | A1 * | 4/2009 | Nou et al. | 399/321 |
| 2010/0202790 | A1 * | 8/2010 | Matsubara et al. | 399/67 |
| 2011/0038653 | A1 * | 2/2011 | Egusa et al. | 399/336 |

FOREIGN PATENT DOCUMENTS

| | | | |
|---|---|---|---|
| JP | 02-221984 | A | 9/1990 |
| JP | 07-276705 | A | 10/1995 |
| JP | 3016685 | B2 | 3/2000 |
| JP | 2005-070536 | A | 3/2005 |
| JP | 2007-304131 | A | 11/2007 |
| JP | 2008-089828 | A | 4/2008 |

* cited by examiner

*Primary Examiner* — David Gray
*Assistant Examiner* — Francis Gray
(74) *Attorney, Agent, or Firm* — Renner, Otto, Boisselle & Sklar, LLP

(57) ABSTRACT

A laser fixing device, which is for use in an electrophotographic image forming apparatus, including: a carrying device for carrying a sheet; and a laser array section which is made up of a plurality of laser sources arrayed in a line, the plurality of laser sources irradiating a non-fixed toner image, which is attached to the sheet that is being carried by the carrying device, with a laser beam so that the non-fixed toner image is fused and fixed to the sheet. In the laser fixing device, an irradiation region length and a sheet carrying speed are set so that $tn \geqq 0.259 \cdot mt^{1.5139}$, where mt is a maximum level of an attached-toner amount per unit area of the sheet ($mg/cm^2$) in the image forming apparatus, and tn is an irradiation region crossing time (msec), which is found by dividing the irradiation region length by the sheet carrying speed, the irradiation region length being a length, in the direction in which the sheet is carried, of a region on the sheet which region is irradiated with the laser beam. According to this configuration, it is possible to prevent a void from occurring in the laser fixing device.

12 Claims, 12 Drawing Sheets

LASER FIXING DEVICE

This Nonprovisional application claims priority under 35 U.S.C. §119(a) on Patent Application No. 2009-207029 filed in Japan on Sep. 8, 2009, the entire contents of which are hereby incorporated by reference.

TECHNICAL FIELD

The present invention relates to a fixing device which irradiates a laser beam to a toner image transferred on a sheet, thereby thermally fixing the toner image onto the sheet.

BACKGROUND ART

Conventionally, a fixing device of a heat roller fixing type has been widely used in an electrophotographic image forming apparatus such as a copying machine and a printer. The fixing device of the heat roller fixing type includes a pair of rollers (a fixing roller and a pressure roller) pressured each other, one or both of which incorporates a halogen heater so as to heat the rollers to a predetermined temperature. The rollers form a nip area (contact area), where a sheet being carried is pressured and heated by the rollers. As a result of the pressure and heat, a non-fixed toner image attached to the sheet is fixed to the sheet.

However, such a fixing device of the heat roller fixing type has involved the following problem. According to the fixing device of the heat roller fixing type, it takes a long time to heat up the fixing roller and the pressure roller so that these rollers are capable of thermal fixing. Therefore, the fixing roller and the pressure roller need to be preheated even in a standby mode. This causes an increase in power consumption.

In order to solve the problem, there has been proposed a laser fixing device which irradiates a laser beam to a non-fixed toner image on a sheet, so that the non-fixed toner image is melted and fixed to the sheet. Such a laser fixing device is disclosed in Patent Literatures 1 and 2. Further, Patent Literature 3 discloses a fixing device which is configured such that only part, of the sheet, where non-fixed toner is positioned is selectively irradiated with the laser beam. Moreover, Patent Literature 4 discloses a fixing device which is configured such that (i) a downstream region of the sheet in a direction in which the sheet is carried and (ii) an upstream region of the sheet in the direction in which the sheet is carried are irradiated with the laser beam so that toner in the downstream region receives a greater amount of heat than toner in the upstream region does.

Citation List

Patent Literatures

Patent Literature 1

Japanese Patent No. 3016685 B (Publication Date: Mar. 6, 2000)

Patent Literature 2

Japanese Patent Application Publication, Tokukai, No. 2005-70536 A (Publication Date: Mar. 17, 2005)

Patent Literature 3

Japanese Patent Application Publication, Tokukaihei, No. 2-221984 A (Publication Date: Sep. 4, 1990)

Patent Literature 4

Japanese Patent Application Publication, Tokukai, No. 2008-89828 A (Publication Date: Apr. 17, 2008)

SUMMARY OF INVENTION

Technical Problem

A laser fixing device carries out laser irradiation so that a top surface of a toner layer on a sheet receives a laser beam. Accordingly, the toner layer is heated up so that a temperature of the toner layer is highest in its top surface and gradually decreases toward its boundary face (a boundary surface between the sheet and the toner layer) where the temperature of the toner layer is the lowest. Therefore, it is necessary to set laser irradiance conditions (an energy density of the laser beam and a total output power of laser array) so that the boundary face has a temperature higher than or equal to a melting point of toner. It is also necessary to set the laser irradiance conditions according to an irradiation region crossing time (a time taken by a point on the sheet to cross a laser irradiation region).

Meanwhile, the inventor of the present invention has found the following fact as a result of the diligent study. According to the laser fixing device, a shorter irradiation region crossing time is more advantageous for energy efficiency because energy loss due to heat transmission to the sheet is reduced. However, in this case, a temperature difference is large between the top surface of the toner layer and the boundary face, because the top surface (surface temperature) should be heated to a higher temperature. Further, if the irradiation region crossing time is extremely short, then the surface temperature of the toner layer drastically rises depending on an amount of toner attached to the sheet. This temperature rise leads to an extremely-high surface temperature, and thus the toner aggregates and/or sublimes. As a result, the toner image on the sheet may suffer from a void (white spot), which is a possible cause of image degradation.

The present invention has been made in view of the above problem, and an object of the present invention is to prevent a void, which is due to an excessively-high surface temperature of the toner layer, from occurring in a laser fixing device.

Solution to Problem

In order to attain the above object, a laser fixing device of the present invention is a laser fixing device, which is for use in an electrophotographic image forming apparatus, including: a carrying device for carrying a sheet; and a laser array section which is made up of a plurality of laser sources arrayed across a direction in which the sheet is carried, the plurality of laser sources irradiating a non-fixed toner image, which is attached to the sheet that is being carried by the carrying device, with a laser beam so that the non-fixed toner image is fused and fixed to the sheet, wherein, $$tn \geqq 0.259 \cdot mt^{1.5139},$$

where mt is a maximum level of an attached-toner amount per unit area of the sheet (mg/cm$^2$) in the image forming apparatus, and tn is an irradiation region crossing time (msec), which is found by dividing an irradiation region length by a sheet carrying speed, the irradiation region length being a length, in the direction in which the sheet is carried, of a region on the sheet which region is irradiated with the laser beam, and where mt is less than or equal to 1.5.

In order to attain the above object, a method of the present invention is a method of designing a laser fixing device, which is for use in an electrophotographic image forming apparatus, the laser fixing device including: a carrying device for carrying a sheet; and a laser array section which is made up of a plurality of laser sources arrayed across a direction in which the sheet is carried, the plurality of laser sources irradiating a non-fixed toner image, which is attached to the sheet that is being carried by the carrying device, with a laser beam so that the non-fixed toner image is fused and fixed to the sheet, said method, including: setting an irradiation region length and a sheet carrying speed so that:

$$tn \geqq 0.259 \cdot mt^{1.5139},$$

where mt is a maximum level of an attached-toner amount per unit area of the sheet (mg/cm$^2$) in the image forming apparatus, and tn is an irradiation region crossing time (msec), which is found by dividing the irradiation region length by the sheet carrying speed, the irradiation region length being a length, in the direction in which the sheet is carried, of a region on the sheet which region is irradiated with the laser beam, and where mt is less than or equal to 1.5.

According to the laser fixing device designed such that $tn \geqq 0.259 \cdot mt^{1.5139}$ as above, it is possible to prevent the void which is due to the excessively-high surface temperature of the toner layer.

In order to attain the above object, a fixing device of the present invention is a laser fixing device, which is for use in an electrophotographic image forming apparatus, including: a carrying device for carrying a sheet; and a laser array section which is made up of a plurality of laser sources arrayed across a direction in which the sheet is carried, the plurality of laser sources irradiating a non-fixed toner image, which is attached to the sheet that is being carried by the carrying device, with a laser beam so that the non-fixed toner image is fused and fixed to the sheet, wherein, $$tn_1 \geqq 0.259 \cdot mt_1^{1.5139},$$

$$tn_2 \geqq 0.259 \cdot mt_2^{1.5139},$$

and $$tn_2 < tn_1,$$

where $mt_1$ is a maximum level of an attached-toner amount per unit area of the sheet (mg/cm$^2$) in the image forming apparatus in a case of multicolor printing, $mt_2$ is a maximum level of an attached-toner amount per unit area of the sheet (mg/cm$^2$) in the image forming apparatus in a case of single color printing, $tn_1$ is an irradiation region crossing time (msec) in the case of multicolor printing, and $tn_2$ (msec) is an irradiation region crossing time (msec) in the case of single color printing, each irradiation region crossing time being found by dividing an irradiation region length by a sheet carrying speed, the irradiation region length being a length, in the direction in which the sheet is carried, of a region on the sheet which region is irradiated with the laser beam, and where $mt_1$ is less than or equal to 1.5, and $mt_2$ is less than $mt_1$.

According to the above laser fixing device designed such that (i) $tn_1 \geqq 0.259 \cdot mt_1^{1.5139}$ in the case of multicolor printing and (ii) $tn_2 \geqq 0.259 \cdot mt_2^{1.5139}$ in the case of the single color printing, it is possible to prevent the void which is due to the excessively-high surface temperature of the toner layer. Further, according to the above configuration in which $tn_2$ is less than $tn_1$, a printing speed is faster in the case of single color printing than in the case of multicolor printing. Accordingly, it is possible to improve productivity of the single color printing.

It should be noted that the multicolor printing refers to printing whereby to from an image made up of toner of two or more colors (e.g., full-color image), whereas the single color printing refers to printing whereby to form an image made up of toner of one color (e.g., black-and-white image).

In order to attain the above object, a fixing device of the present invention is a laser fixing device, which is for use in an electrophotographic image forming apparatus, including: a carrying device for carrying a sheet; and a laser array section which is made up of a plurality of laser sources arrayed across a direction in which the sheet is carried, the plurality of laser sources irradiating a non-fixed toner image, which is attached to the sheet that is being carried by the carrying device, with a laser beam so that the non-fixed toner image is fused and fixed to the sheet, wherein, $$tn \geqq 0.6407 \cdot mt + 0.1459,$$

where mt is a maximum level of an attached-toner amount per unit area of the sheet (mg/cm$^2$) in the image forming apparatus, and tn is an irradiation region crossing time (msec), which is found by dividing an irradiation region length by a sheet carrying speed, the irradiation region length being a length, in the direction in which the sheet is carried, of a region on the sheet which region is irradiated with the laser beam, and where mt is less than or equal to 1.5.

In order to attain the above object, a method of the present invention is a method of designing a laser fixing device, which is for use in an electrophotographic image forming apparatus, the laser fixing device including: a carrying device for carrying a sheet; and a laser array section which is made up of a plurality of laser sources arrayed across a direction in which the sheet is carried, the plurality of laser sources irradiating a non-fixed toner image, which is attached to the sheet that is being carried by the carrying device, with a laser beam so that the non-fixed toner image is fused and fixed on the sheet, said method, including: setting an irradiation region length and a sheet carrying speed so that:

$$tn \geqq 0.6407 \cdot mt + 0.1459,$$

where mt is a maximum level of an attached-toner amount per unit area of the sheet (mg/cm$^2$) in the image forming apparatus, and tn is an irradiation region crossing time (msec), which is found by dividing the irradiation region length by the sheet carrying speed, the irradiation region length being a length, in the direction in which the sheet is carried, of a region on the sheet which region is irradiated with the laser beam, and where mt is less than or equal to 1.5.

According to the above laser fixing device designed such that $tn \geqq 0.6407 \cdot mt + 0.1459$, it is possible to prevent the void which is due to the excessively-high surface temperature of the toner layer. Further, according to the laser fixing device designed such that $tn \geqq 0.6407 \cdot mt + 0.1459$, it is possible to prevent ignition of the sheet even if the sheet being carried is suddenly stopped due to a trouble during a fixing process.

In order to attain the above object, a fixing device of the present invention is a laser fixing device, which is for use in an electrophotographic image forming apparatus, including: a carrying device for carrying a sheet; and a laser array section which is made up of a plurality of laser sources arrayed across a direction in which the sheet is carried, the plurality of laser sources irradiating a non-fixed toner image, which is attached to the sheet that is being carried by the carrying device, with a laser beam so that the non-fixed toner image is fused and fixed to the sheet, wherein, $$tn_1 \geqq 0.6407 \cdot mt_1 + 0.1459$$

$$tn_2 \geqq 0.6407 \cdot mt_2 + 0.1459,$$

and $$tn_2 < tn_1,$$

where $mt_1$ is a maximum level of an attached-toner amount per unit area of the sheet (mg/cm$^2$) in the image forming apparatus in a case of multicolor printing, $mt_2$ is a maximum level of an attached-toner amount per unit area of the sheet (mg/cm$^2$) in the image forming apparatus in a case of single color printing, $tn_1$ is an irradiation region crossing time (msec) in the case of multicolor printing, and $tn_2$ (msec) is an irradiation region crossing time (msec) in the case of single color printing, each irradiation region crossing time being found by dividing an irradiation region length by a sheet carrying speed, the irradiation region length being a length, in the direction in which the sheet is carried, of a region on the sheet which region is irradiated with the laser beam, and where $mt_1$ is less than or equal to 1.5, and $mt_2$ is less than $mt_1$.

According to the above laser fixing device designed such that (i) $tn_1 \geqq 0.6407 \cdot mt_1 + 0.1459$ in the case of multicolor printing and (ii) $tn_2 \geqq 0.6407 \cdot mt_2 + 0.1459$ in the case of single color printing, it is possible to prevent the void which is due to the excessively-high surface temperature of the toner layer, while preventing ignition of the sheet even if the sheet being carried is suddenly stopped due to a trouble during the fixing process. Further, according to the above configuration in which $tn_2$ is less than $tn_1$, a printing speed is faster in the case of single color printing than in the case of multicolor printing. Accordingly, it is possible to improve productivity of the single color printing.

Advantageous Effects of Invention

According to the present invention, the laser fixing device is designed such that $tn \geqq 0.259 \cdot mt^{1.5139}$. As such, it is possible to prevent the void which is due to the excessively-high surface temperature of the toner layer.

BRIEF DESCRIPTION OF DRAWINGS

FIG. 1 is a view schematically illustrating an overall configuration of an image forming apparatus including a fixing device of the present embodiment.

FIG. 2 is a view illustrating the configuration of the fixing device of the present embodiment.

FIG. 3 is an elevation view schematically illustrating laser array included in the fixing device of FIG. 2.

FIG. 4 is a side view schematically illustrating the laser array of FIG. 3.

FIG. 5 is a block diagram illustrating hardware included in the fixing device of FIG. 2.

FIG. 6 is a modeled view illustrating how a fixing is carried out in a laser fixing method.

Figure 7:
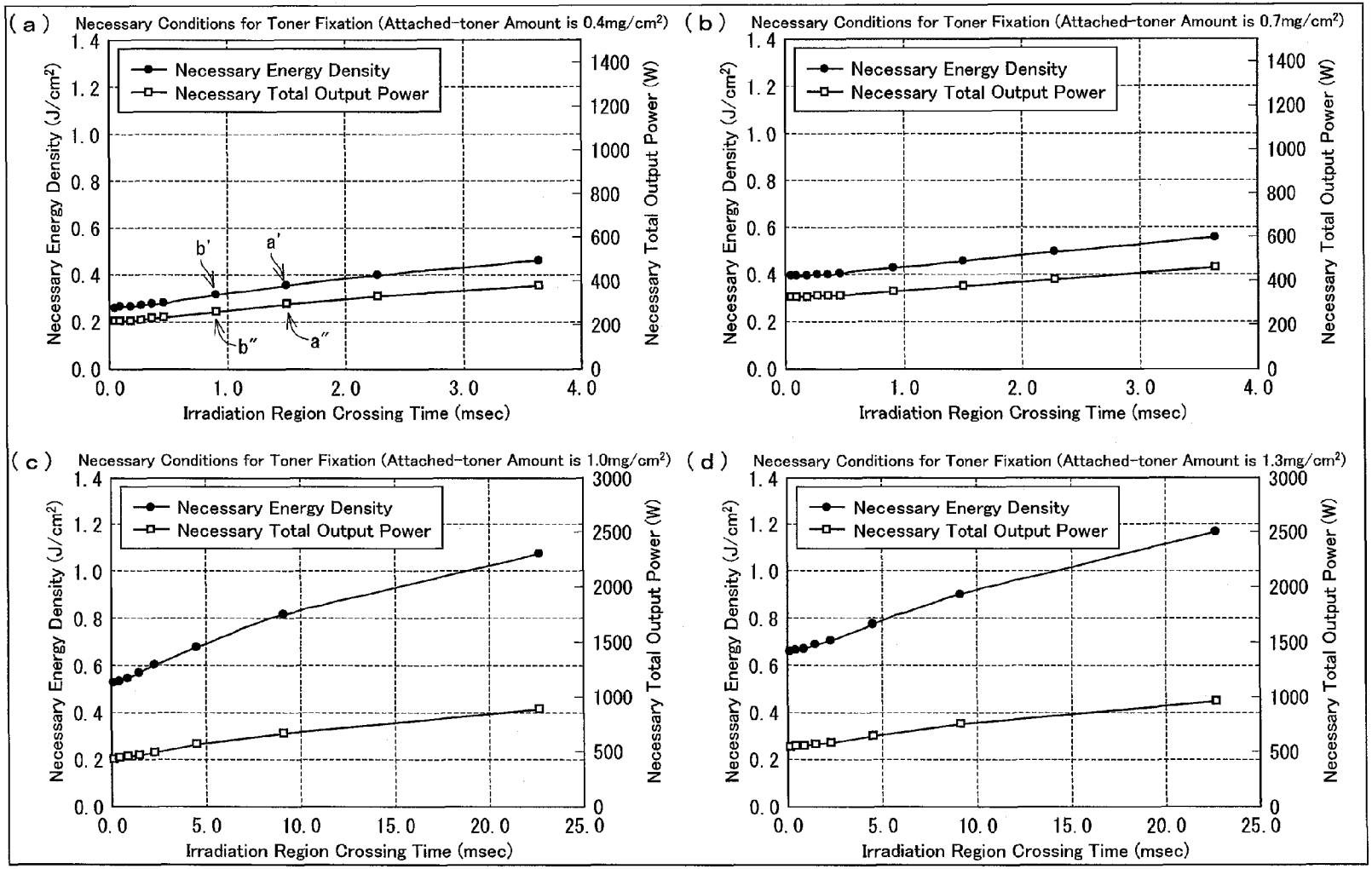
FIG. 7

(a) of FIG. 7 is a graph, plotting a necessary energy density and a necessary total output power against an irradiation region crossing time, where an amount of attached toner is 0.4 mg/cm$^2$. (b) of FIG. 7 is a graph, plotting the necessary energy density and the necessary total output power against the irradiation region crossing time, where the amount of attached toner is 0.7 mg/cm$^2$. (c) of FIG. 7 is a graph, plotting the necessary energy density and the necessary total output power against the irradiation region crossing time, where the amount of attached toner is 1.0 mg/cm$^2$. (d) of FIG. 7 is a graph, plotting the necessary energy density and the necessary total output power against the irradiation region crossing time, where the amount of the attached toner is 1.3 mg/cm$^2$.

FIG. 8

Figure 8:
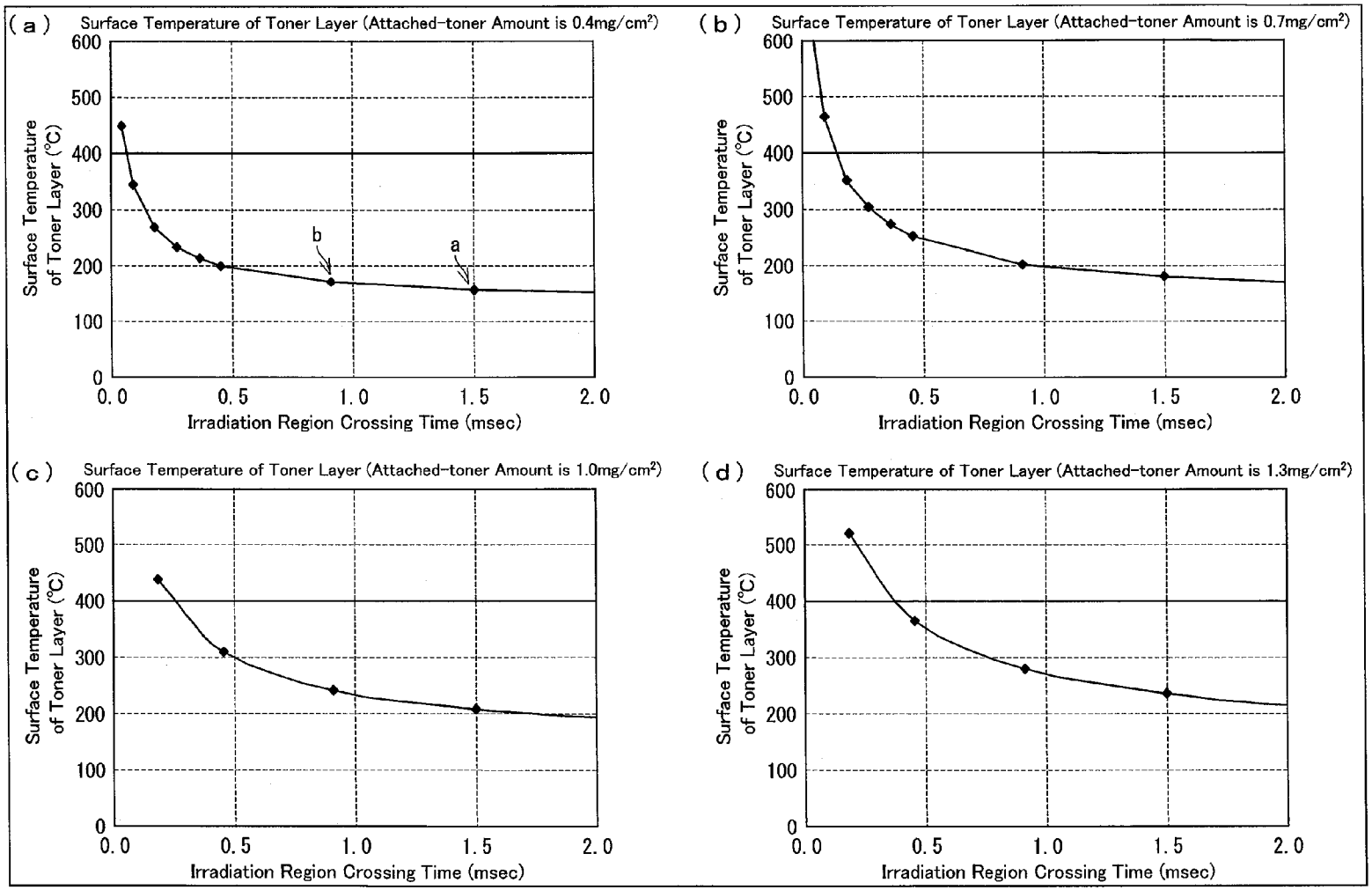

(a) of FIG. 8 is a graph, which illustrates how the irradiation region crossing time is related to a surface temperature of a toner layer, where the amount of attached toner is 0.4 mg/cm$^2$. (b) of FIG. 8 is a graph, which illustrates how the irradiation region crossing time is related to the surface temperature of the toner layer, where the amount of the attached toner is 0.7 mg/cm$^2$. (c) of FIG. 8 is a graph, which illustrates how the irradiation region crossing time is related to the surface temperature of the toner layer, where the amount of the attached toner is 1.0 mg/cm$^2$. (d) of FIG. 8 is a graph, which illustrates how the irradiation region crossing time is related to the surface temperature of the toner layer, where the amount of the attached toner is 1.3 mg/cm$^2$.

FIG. 9

Figure 9:
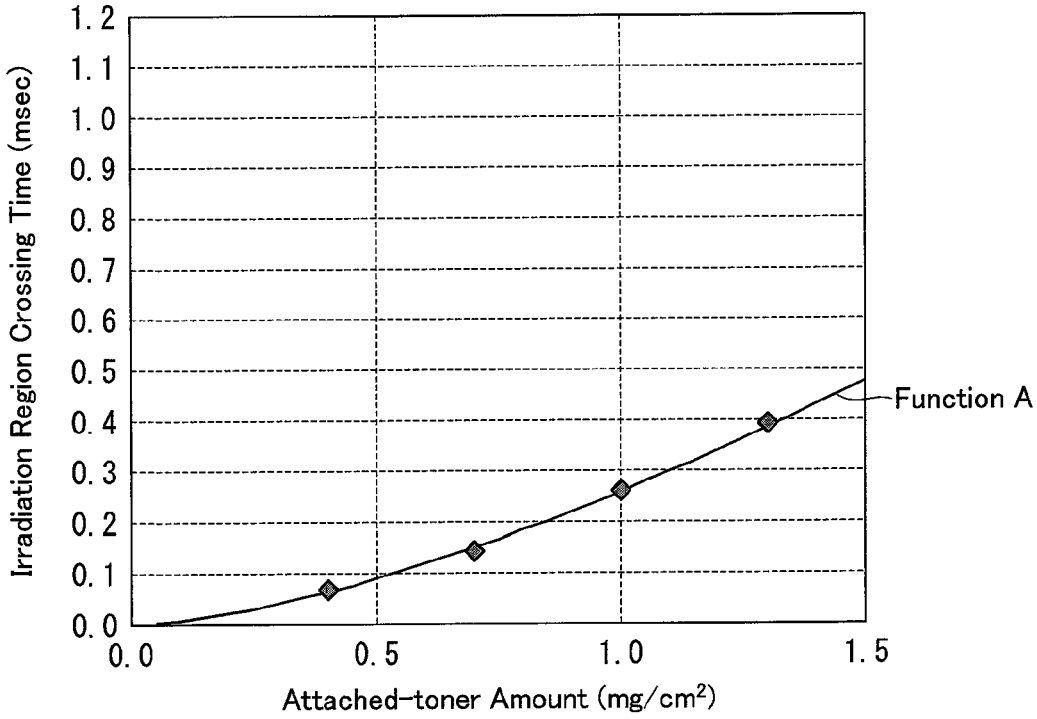

FIG. 9 is a graph of function A, which indicates a relation between the irradiation region crossing time and the amount of the attached toner, the relation achieving that the surface temperature of the toner layer is 400° C.

FIG. 10

Figure 10:
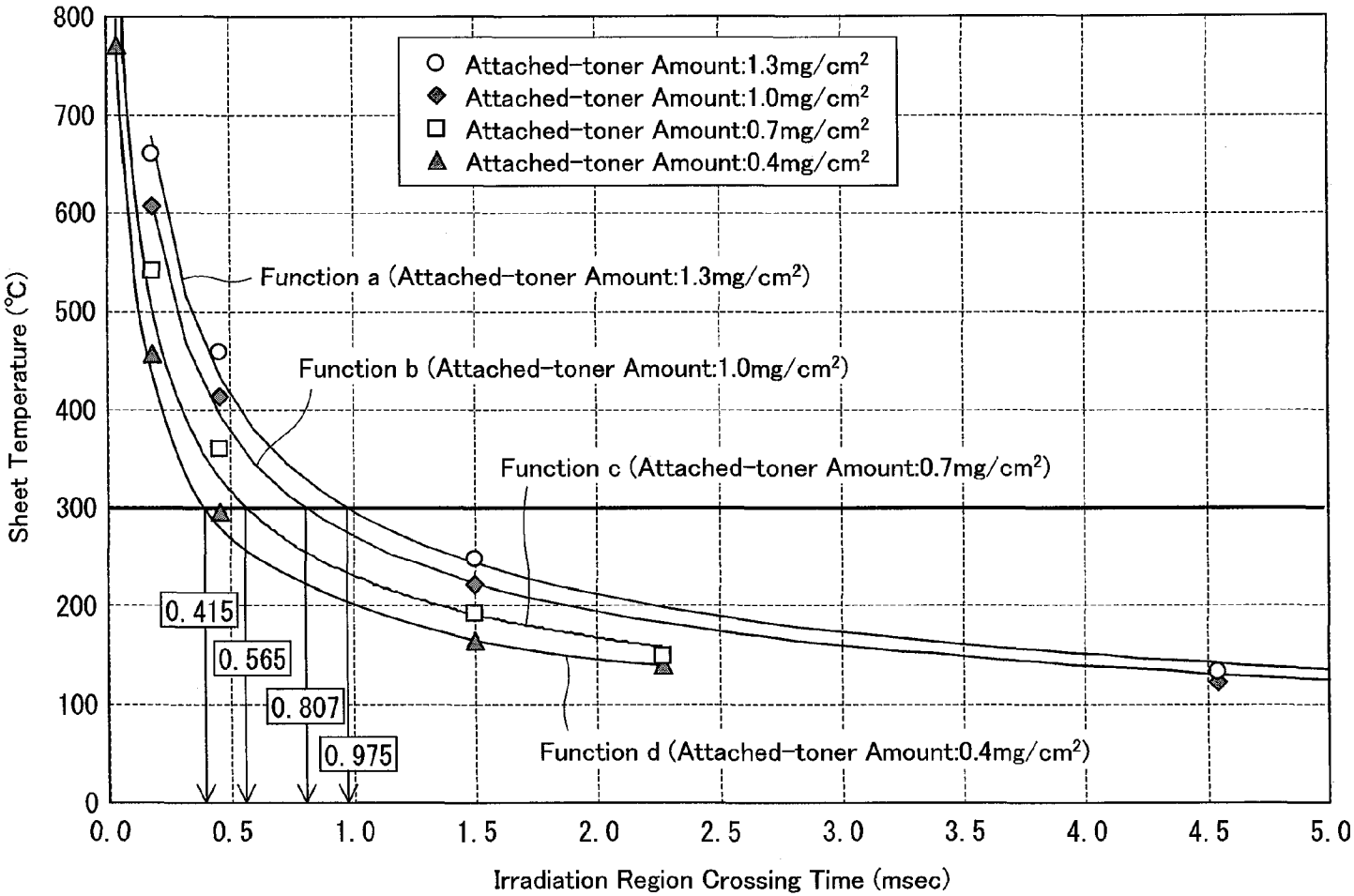

FIG. 10 is a graph, which illustrates, for each amount of the attached toner, how the irradiation region crossing time is related to a temperature of a sheet immediately after stopping transportation of the sheet.

FIG. 11

Figure 11:
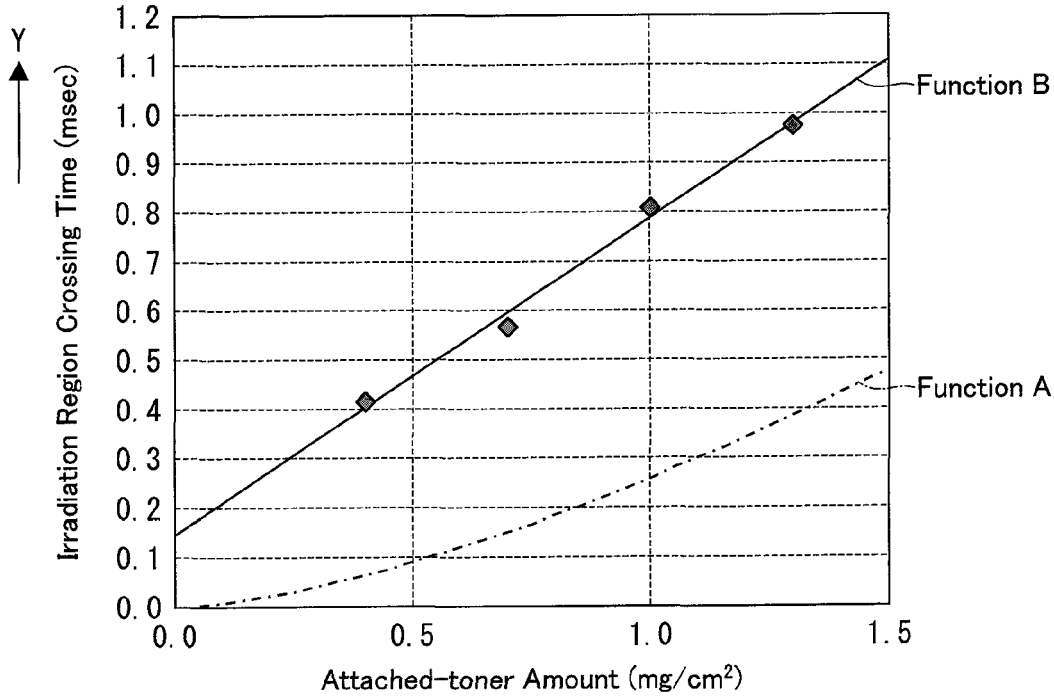

FIG. 11 is a graph of function B, which indicates a relation between the irradiation region crossing time and the amount of the attached toner, the relation achieving that the temperature of the sheet immediately after stopping transportation of the sheet is 300° C.

FIG. 12

Figure 12:
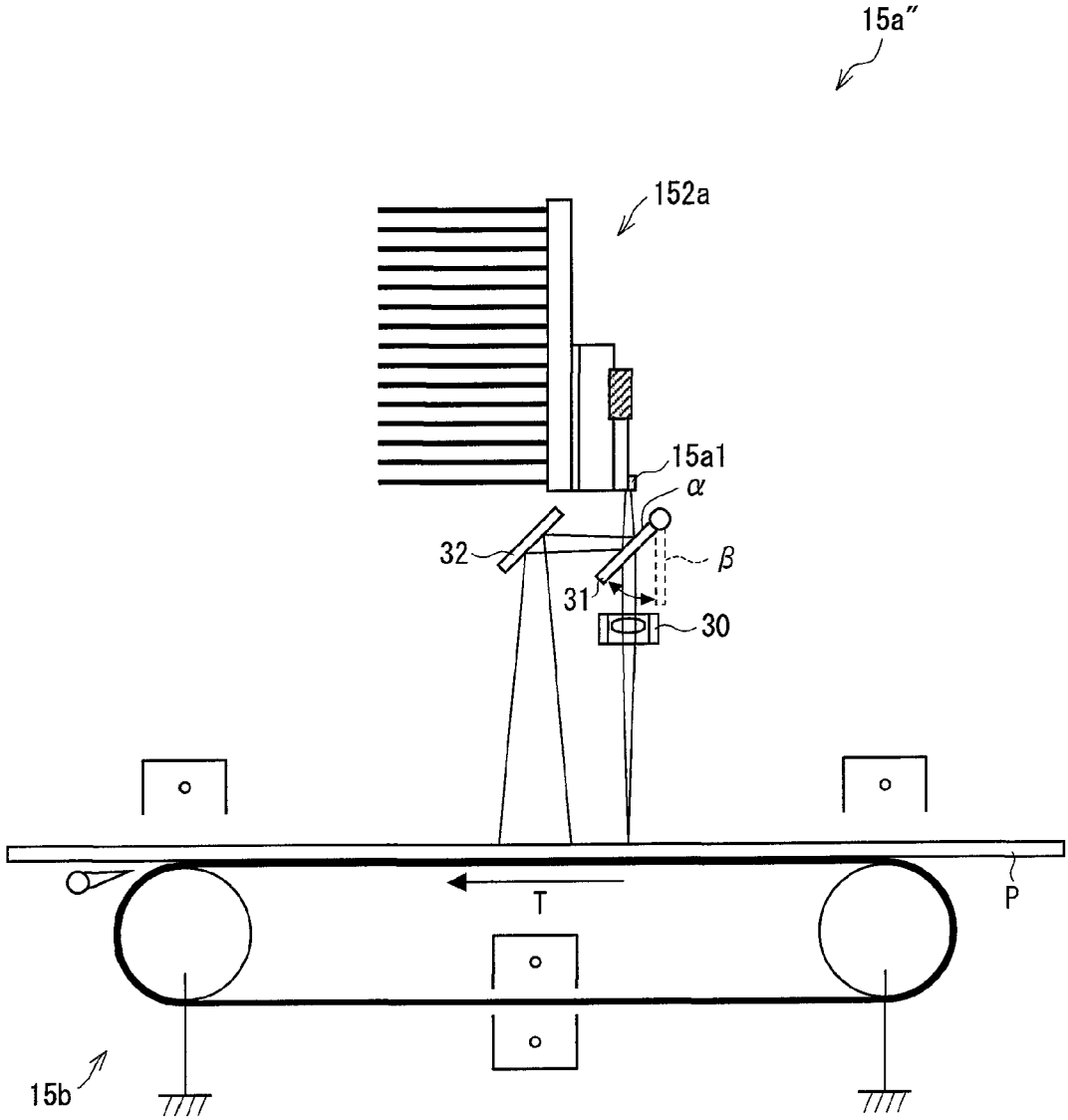

FIG. 12 illustrates a second modification of the fixing device of the present embodiment.

FIG. 13

Figure 13:
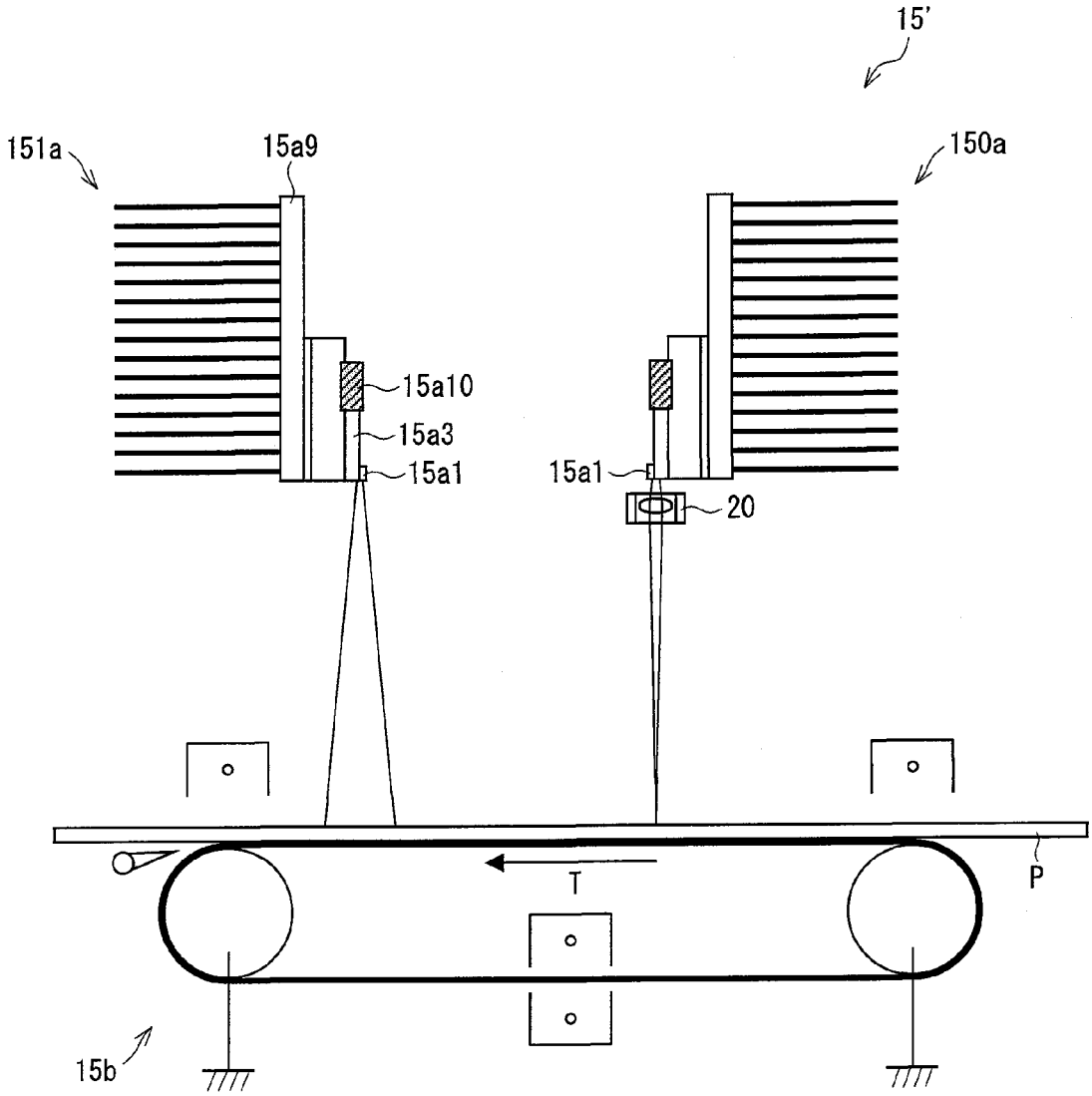

FIG. 13 illustrates a first modification of the fixing device of the present embodiment.

DESCRIPTION OF EMBODIMENTS

[Configuration of Image Forming Apparatus]

Figure 1:
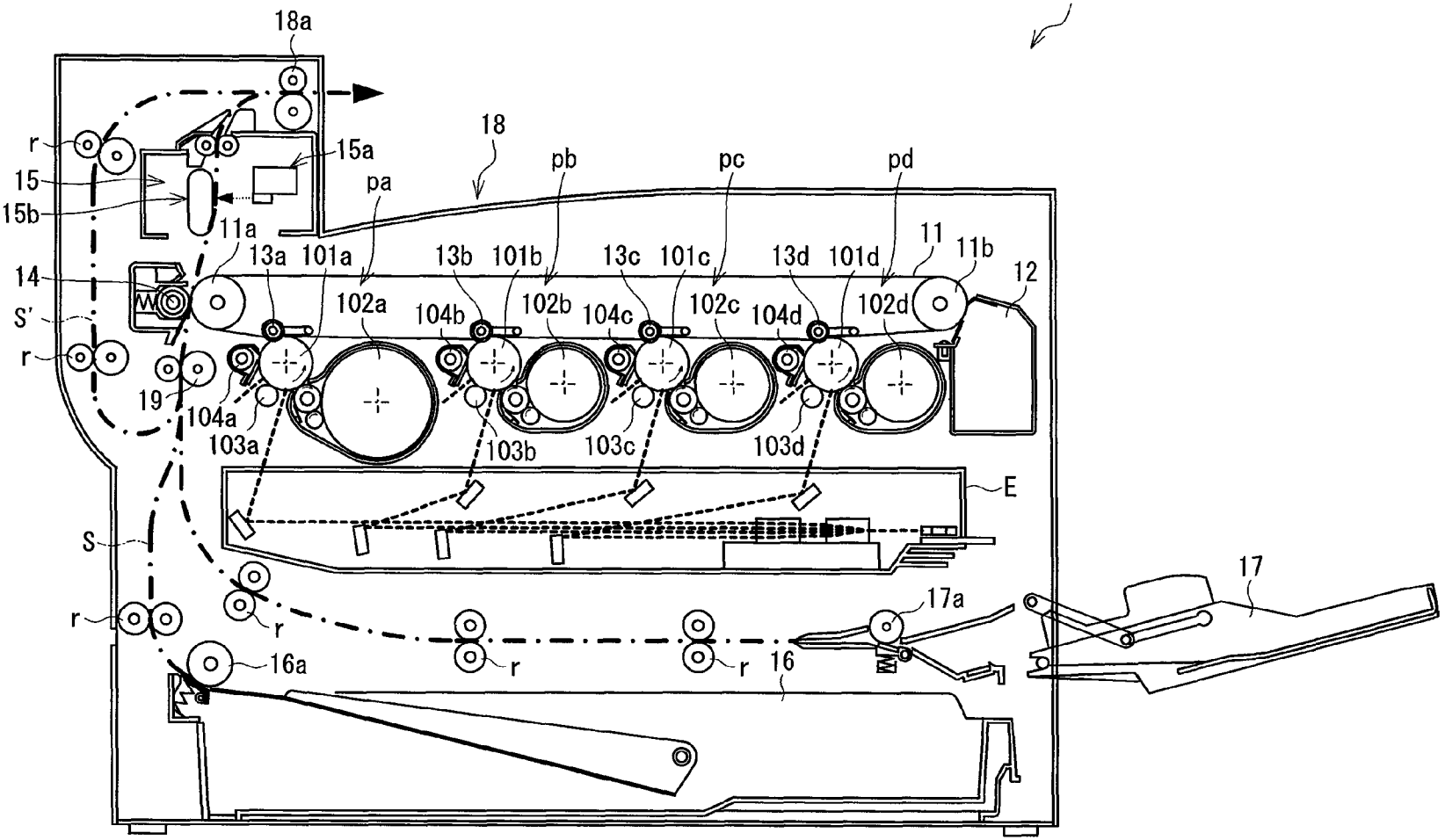
FIG. 1

An embodiment of the present invention is described below with reference to the drawings. FIG. 1 is a view schematically illustrating an overall configuration of an image forming apparatus including a fixing device of the present embodiment.

An image forming apparatus 100 is an electrophotographic printer which forms, on a predetermined sheet, a multicolor image or a single color image according to image data etc. The image data is supplied from a terminal device on the network or the like device. The image forming apparatus 100 can either be a multifunction printer or a printer included in a copying machine.

As illustrated in FIG. 1, the image forming apparatus 100 includes an optical unit E, visible image-forming units pa, pb, pc, and pd, an intermediate transfer belt 11, a second transfer unit 14, a fixing device (fixing unit) 15, an internal sheet feeding unit 16, and a manual sheet feeding unit 17.

As illustrated in FIG. 1, the visible image-forming unit pa includes a photoreceptor drum 101*a*, the visible image-forming unit pb includes a photoreceptor drum 101*b*, the visible image-forming unit pc includes a photoreceptor drum 101*c*, and the visible image-forming unit pd includes a photoreceptor drum 101*d*.

The optical unit E is designed such that the photoreceptor drums of the four visible image-forming units pa, pb, pc, and pd are each exposed to a laser beam emitted from a laser source in the optical unit E. Specifically, the optical unit E includes (i) the laser source which emits the laser beam in accordance with (a) image data read out from a memory or (b) image data supplied from an external device, (ii) polygon mirrors each of which deflects the laser beam, (iii) f–θ lenses each of which compensates the deflected laser beam, and (iv)

the like. Such an optical unit E irradiates the photoreceptor drums 101*a*, 101*b*, 101*c*, and 101*d*, which have been electrically charged, with the laser beam in accordance with the received image data. In this way, an electrostatic latent image is formed on a surface of each of the respective photoreceptor drums 101*a*, 101*b*, 101*c*, and 101*d*.

The visible image-forming unit pa further includes, around the photoreceptor drum 101*a*, (i) a developing unit 102*a*, (ii) a charging unit 103*a*, (iii) a cleaning unit 104*a*, and (iv) a first transfer unit 13*a*. The developing unit 102*a* contains black (B) toner.

The charging unit 103*a* electrically charges a surface of the photoreceptor drum 101*a*. The charging unit 103*a* is in a form of roller, so as to uniformly charge the surface of the photoreceptor drum 101*a* with ozone generation suppressed as low as possible. The developing unit (developing device) 102*a* supplies toner to the electrostatic latent image formed on the surface of the photoreceptor drum 101*a* as a result of the laser irradiation by the optical unit E. In this way, the developing unit 102*a* forms a toner image on the photoreceptor drum 101*a*. The first transfer unit 13*a*, which pressures the photoreceptor drum 101*a* via the intermediate transfer belt 11, is a transfer device for transferring the toner image formed on the surface of the photoreceptor drum 101*a* to the intermediate transfer belt 11. The cleaning unit 104*a* is for removing toner left on the surface of the photoreceptor drum 101*a* after the toner image is transferred to the intermediate transfer belt 11.

The above configuration applies also to the other three visible image-forming units pb, pc, and pd. Therefore, descriptions of constituent elements of the visible image-forming units pb, pc, and pd are omitted here. Note however that developing units 102*b*, 102*c*, and 102*d* of the above three visible image-forming units contain yellow (Y) toner, magenta (M) toner, and cyan (C) toner, respectively.

The intermediate belt 11 is suspended with tension by tension rollers 11*a* and 11*b*, along the neighboring visible image-forming units pa, pb, pc, and pd which are arrayed in a line. The intermediate transfer belt 11 is designed to contact a waste toner box 12 at a region facing the tension roller 11*b*, and the second transfer unit 14 at on a region facing the tension roller 11*a*.

The second transfer unit 14 is for transferring, to a sheet, the toner image which has been temporarily attached to the intermediate transfer belt 11.

The fixing device 15 includes a laser array 15*a* and a sheet carrying device 15*b*, and fixes the toner image to the sheet by using a laser beam. Specifically, the fixation is carried out in the following manner. The laser array 15*a* irradiates, with the laser beam, a non-fixed toner image attached to the sheet which is being carried by the sheet carrying device 15*b*. In this way, the non-fixed toner image is melted and fixed to the sheet. The fixing device 15 is provided downstream of the second transfer unit 14 in a direction in which the sheet is carried.

The internal sheet feeding unit 16 is provided below the optical unit E. The manual sheet feeding unit 17 is provided externally of the image forming apparatus 100 on a side surface of the image forming apparatus 100. Further, provided on a top surface of the image forming apparatus 100 is a sheet output tray 18, which receives a printed sheet face-down.

Moreover, the image forming apparatus 100 includes a sheet carrying path S, which guides a sheet from the internal sheet feeding unit 16 or from the manual sheet feeding unit 17, via the second transfer unit 14 and the fixing device 15, to the sheet output tray 18.

Alongside the sheet carrying path S, there are sheet feeding rollers 16*a* and 17*a*, a registration roller 19, the second transfer unit 14, the fixing device 15, carrying rollers r, a sheet outputting roller 18*a*, and the like.

The carrying rollers r are small rollers for accelerating and supporting forward movement of the sheet, and provided alongside the sheet carrying path S. The sheet feeding roller 16*a* is a suction roller for feeding sheets from the internal sheet feeding unit 16 to the sheet carrying path S one by one, and provided at an end of the internal sheet feeding unit 16. The sheet feeding roller 17*a* is a suction roller for feeding sheets from the manual sheet feeding unit 17 to the sheet carrying path S one by one, and provided near the manual sheet feeding unit 17.

The registration roller 19 temporarily holds a sheet traveling in the sheet carrying path S. Then, the registration roller 19 starts feeding the sheet to a transfer section of the second transfer unit 14 so that an edge of the sheet matches an edge of the toner image formed on the intermediate transfer belt 11.

The following description discusses how a sheet is carried. As described above, the image forming apparatus 100 includes (i) the internal sheet feeding unit 16 which stores sheets in advance and (ii) the manual sheet feeding unit 17 which is used in a case where one or several sheets are printed or in the like cases (see FIG. 1). The internal sheet feeding unit 16 and the manual sheet feeding unit 17 are provided with the sheet feeding roller 16*a* and the sheet feeding roller 17*a*, respectively. Each of the sheet rollers 16*a* and 17*a* guides the sheets to the sheet carrying path S one by one.

In a case of one-side printing, the sheet supplied from the internal sheet feeding unit 16 is carried, to the registration roller 19, by the carrying rollers r provided alongside the sheet carrying path S. The registration roller 19 carries the sheet to the transfer section of the second transfer unit 14 so that the edge of the sheet matches the edge of the toner image formed on the intermediate transfer belt 11. The toner image formed on the intermediate belt 11 is transferred to the sheet in this transfer section, and then fixed to the sheet in the fixing device 15. Thereafter, the sheet is outputted to the sheet outputting tray 18 via the sheet outputting roller 18*a*.

Meanwhile, the sheet supplied from the manual sheet feeding unit 17 is carried to the registration roller 19 via a plurality of carrying rollers r. Thereafter, the sheet is subjected to the same operations as those of the sheet supplied from the internal sheet feeding unit 16. That is, the sheet supplied from the manual sheet feeding unit 17 is outputted to the sheet output tray 18 via the second transfer unit 14 and the fixing device 15.

In a case of double-side printing, the sheet having been one-side printed and passed through the fixing device 15 is carried to the sheet output roller 18*a*, and then is chucked by the sheet outputting roller 18*a* at a rear end of the sheet. Then, the sheet is sent to an inversion path S' by the sheet output roller 18*a* inversely rotating, and then passes through the registration roller 19 so as to be printed on its other side. Thereafter, the sheet is outputted to the sheet output tray 18.

The following description discusses an image forming process carried out by the image forming apparatus 100. In the visible image forming unit pa, first, a surface of the photoreceptor drum 101*a* is electrically charged uniformly by the charging unit 103*a*. Next, the optical unit E forms an electrostatic latent image on the surface of the photoreceptor drum 101*a*. Then, the developing unit 102*a* develops the electrostatic latent image on the surface of the photoreceptor drum 101*a* so as to obtain a toner image. The toner image made visible on the surface of the photoreceptor drum 101*a* is then transferred to a surface of the intermediate transfer belt 11 by the first transfer unit 13*a*, which is supplied with a bias voltage having a polarity opposite to that of the toner image. This process is carried out also in the other three visible image forming units pb, pc and pd. In this way, toner images are sequentially transferred to the surface of the intermediate transfer belt 11, thereby forming a multicolor toner image.

The multicolor toner image formed on the surface of the intermediate transfer belt 11 is then transferred to a sheet by the second transfer unit 14, which is supplied with a bias voltage having a polarity opposite to that of the multicolor toner image. The sheet having the multicolor toner image (non-fixed toner image) attached thereto is then carried to the fixing device 15, where the non-fixed toner image is heated by laser irradiation so as to be melted and fixed to a surface of the sheet. Thereafter, the sheet is outputted to the external sheet output tray 18 via the sheet output roller 18*a*.

[Configuration of Fixing Device]

Figure 2:
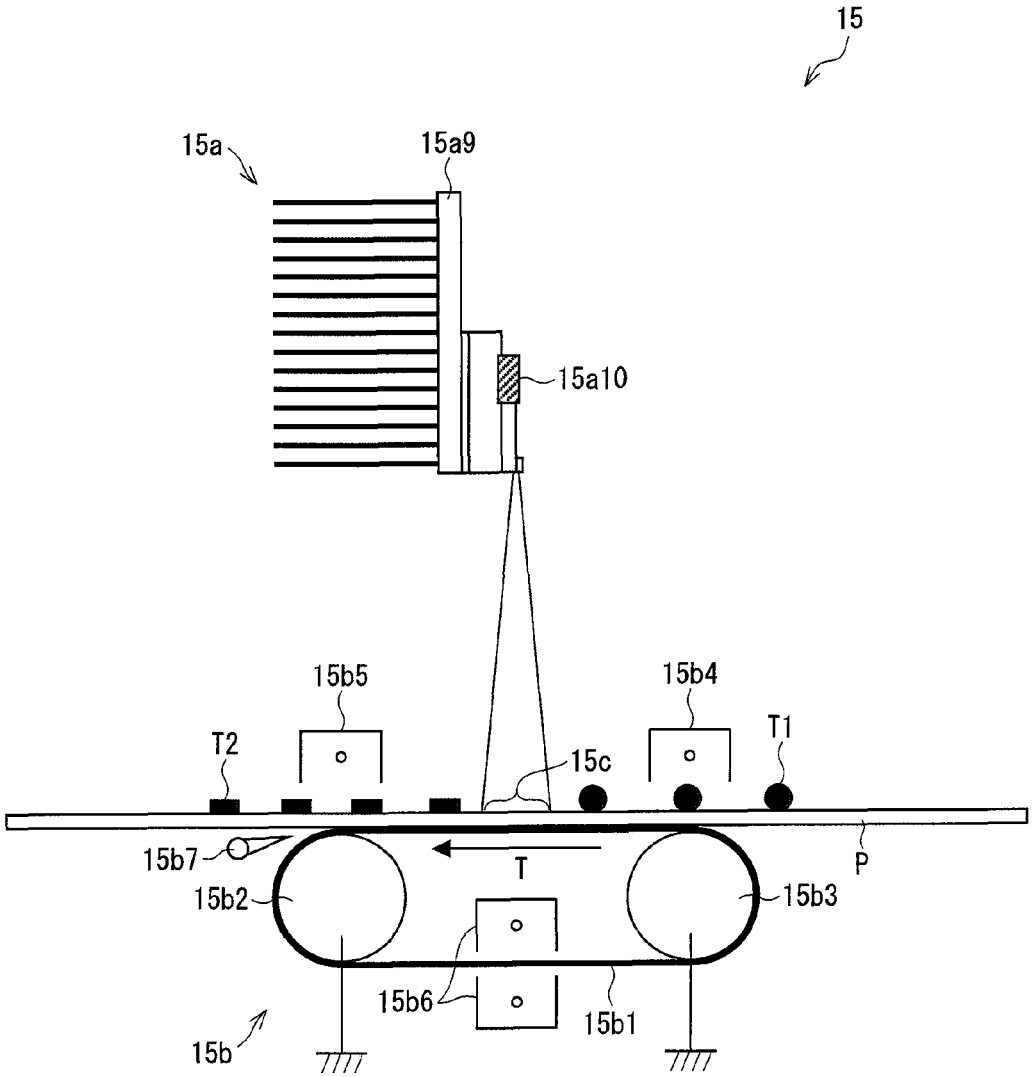
FIG. 2
Figure 3:
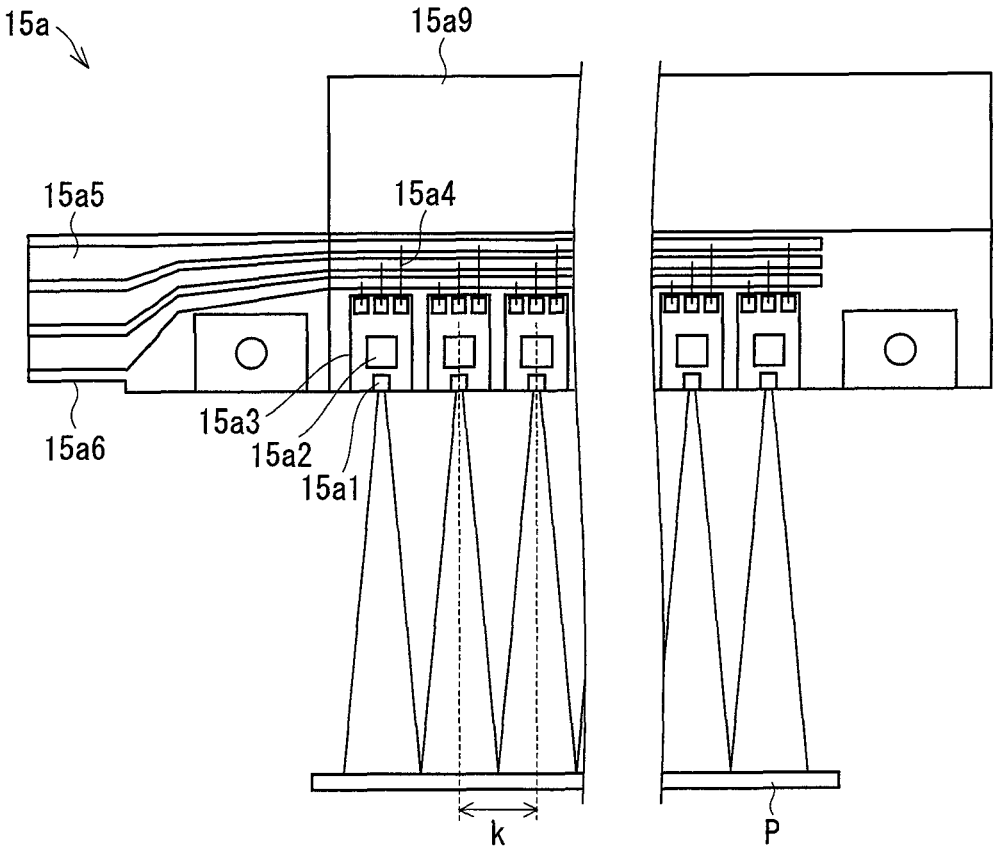
FIG. 3
Figure 4:
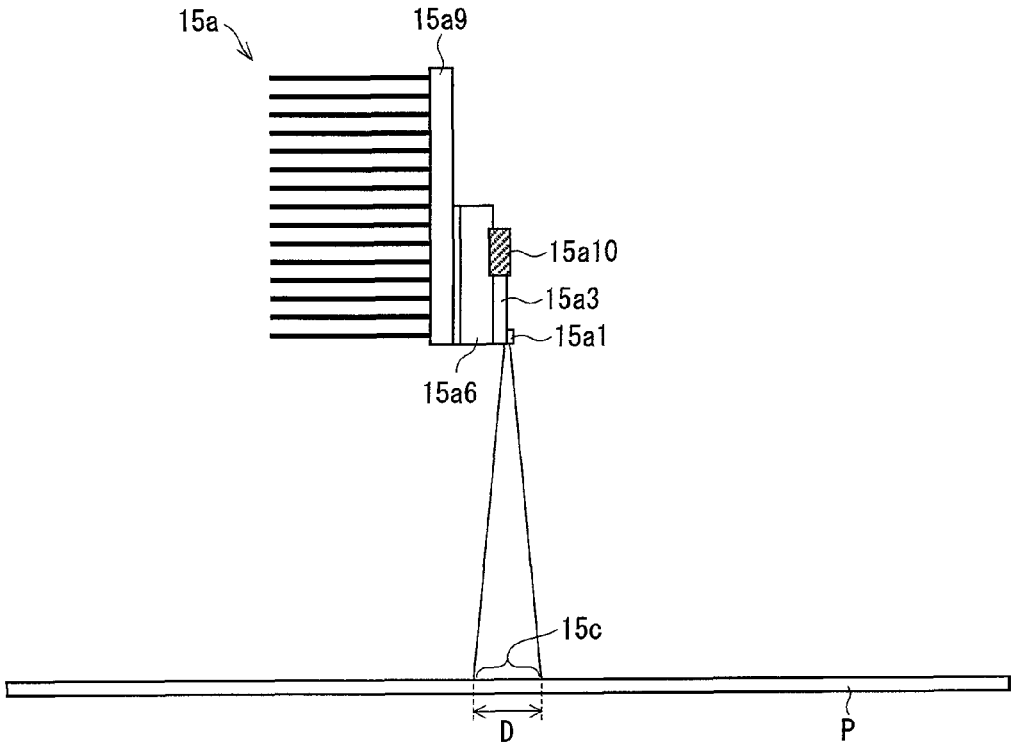
FIG. 4
Figure 5:
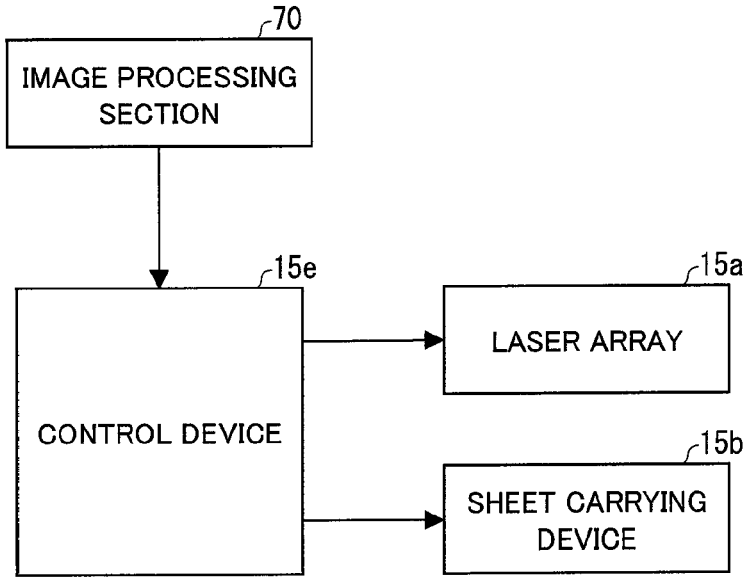
FIG. 5

The following description discusses a configuration of the fixing device (laser fixing device) 15 of the present embodiment. FIG. 2 is a view illustrating the configuration of the fixing device of the present embodiment. FIG. 3 is an elevation view schematically illustrating laser array included in the fixing device of FIG. 2. FIG. 4 is a side view schematically illustrating the laser array of FIG. 3. FIG. 5 is a block diagram illustrating hardware included in the fixing device of the present embodiment.

As illustrated in FIG. 2, the fixing device 15 includes a laser array (laser array section) 15*a* and a sheet carrying device (carrying device) 15*b*. Further, as illustrated in FIG. 5, the fixing device 15 includes a control device 15*e* which is connected to the laser array 15*a* and to the sheet carrying device 15*b*. The control device (carriage control section, array control section) 15*e* is for controlling operations of the laser array 15*a* and the sheet carrying device 15*b*.

As illustrated in FIG. 2, the fixing device 15 is configured such that the laser array 15*a* emits a laser beam to the sheet being carried by the sheet carrying device 15*b*. Let a region (spot) which is irradiated with the laser beam be referred to as an irradiation region 15*c* (see FIG. 2). When the sheet P passes through the fixing device 15, non-fixed toner on a surface of the sheet P is irradiated with the laser beam in this irradiation region 15*c*. Then, the non-fixed toner is thermally fused, and fixed to the sheet P. In FIG. 2, a reference numeral T1 indicates the non-fixed toner, and a reference numeral T2 indicates fixed toner.

The following description discusses the sheet carrying device 15*b*. As illustrated in FIG. 2, the sheet carrying device 15*b* includes a carrying belt 15*b*1, a driving roller 15*b*2, a driven roller 15*b*3, an attachment charger 15*b*4, a sheet charge neutralizer 15*b*5, a belt charge neutralizer 15*b*6, a separation blade 15*b*7, and a drive motor (not illustrated).

The carrying belt 15*b*1 is an endless belt made of polyimide resin, and has a belt thickness of 75 (μm) and a volume resistivity of $1.0\times10^{16}$ (Ω·cm). The carrying belt 15*b*1 is suspended with tension by the driving roller 15*b*2 and the driven roller 15*b*3.

The driving roller 15*b*2 is rotated at a predetermined rotation speed by the drive motor, which is controlled by the control device 15*e*. Specifically, the carrying belt 15*b*1 rotates in a T direction at a predetermined sheet carrying speed Vp (mm/sec) according to the rotation of the driving roller 15*b*2. The carrying belt 15*b*1 is surrounded by the attachment charger 15*b*4, the sheet charge neutralizer 15*b*5, the belt charge neutralizer 15*b*6, and the separation blade 15*b*7.

In such a sheet carrying device 15*b*, the sheet P having been sent out from the second transfer unit 14 is carried into a region, on the surface of the carrying belt 15*b*1, between the driven roller 15*b*3 and the attachment charger 15*b*4.

The driven roller 15*b*3 is made of a conductive material, and is grounded. The attachment charger 15*b*4 electrically charges the sheet P at a region, on the surface of the carrying belt 15*b*1, facing the driven roller 15*b*3, thereby causing dielectric polarization between the sheet P and the carrying belt 15*b*1. In this way, the sheet P is electrostatically attached to the surface of the carrying belt 15*b*1.

Meanwhile, the carrying belt 15*b*1 rotates in the T direction according to the rotation of the driving roller 15*b*2. Accordingly, the sheet P, which is attached to the surface of the carrying belt 15*b*1, is carried to the region which is irradiated with the laser beam.

The laser array 15*a* emits the laser beam to the sheet P. This is described below in detail.

As illustrated in FIG. 5, the control device 15*e* for controlling the laser array 15*a* is connected with an image processing section 70. The image processing section 70 is for processing externally-supplied image data, and controlling the optical unit E in accordance with the processed image data so that latent images according to the image data are formed on the surfaces of the photoreceptor drums. That is, the image data is, in other words, data which indicates where on the sheet P to form an image.

The control device 15*e* receives the image data from the image processing section 70. Then, the control device 15*e* switches ON or OFF each of light sources (semiconductor laser elements) included in the laser array 15*a* in accordance with the image data. In this way, the region, of the sheet P, where the toner (non-fixed toner) is attached is selectively irradiated with the laser beam. Accordingly, the region, of the sheet P, where the non-fixed toner is attached is surely irradiated with the laser beam, whereas the other region, of the sheet P, where the non-fixed toner is not attached includes an area not irradiated with the laser beam. The non-fixed toner having been irradiated with the laser beam is thermally fused and fixed to the sheet P.

After the toner is fixed, the sheet P which is electrostatically attached to the carrying belt 15*b*1 is carried to a region between the sheet charge neutralizer 15*b*5 and the driving roller 15*b*2. The driving roller 15*b*2 is made of a conductive material, and is grounded. The sheet charge neutralizer 15*b*5 removes the electric charge from the surface of the sheet P which is attached to the carrying belt 15*b*1, thereby reducing electrostatic attraction force between the carrying belt 15*b*1 and the sheet P.

After the electrostatic attraction force is reduced, an anterior end of the sheet P starts coming off from the carrying belt 15*b*1 when the anterior end reaches a region, facing the driving roller 15*b*2, where the carrying belt 15*b*1 has a large curvature. The separation blade 15*b*7 helps the sheet P completely separate from the carrying belt 15*b*1. After the sheet P is separated from the carrying belt 15*b*1, the belt charge neutralizer 15*b*6 removes the electric charge from a front surface and back surface of the carrying belt 15*b*1. Then, the carrying belt 15*b*1 is back to the region where a subsequent sheet P is to be attached to the carrying belt 15*b*1.

The following description discusses the laser array 15*a* in more detail. The laser array 15*a* irradiates, with the laser beam, a non-fixed toner image which is attached to the sheet P so as to fix toner to the sheet P.

As illustrated in FIGS. 3 and 4, the laser array 15*a* includes a ceramic substrate 15*a*6 and silicon substrates 15*a*3. On the ceramic substrate 15*a*6, a surface electrode 15*a*5 is provided. On each of the silicon substrates 15*a*3, a monitor photodiode 15*a*2 and a driver circuit (not illustrated) are monolithically provided. The surface electrode 15a5 and the silicon substrates 15a3 are electrically connected with each other via bonding wires 15a4. On each of the silicon substrates 15a3, a semiconductor laser element (chip) 15a1, which is a laser source, is mounted in such a manner that the semiconductor element 15a1 and the silicon substrate 15a3 are electrically connected with each other.

The number of the silicon substrates 15a3 included in the laser array 15a is plural (one thousand in this embodiment). That is, the laser array 15a of FIG. 3 includes one-thousand semiconductor laser elements 15a1. Here, the semiconductor laser elements 15a1 are arrayed in a line in a predetermined direction (a direction perpendicular to [across] a direction in which a sheet is carried and parallel to a surface of the sheet).

That is, the laser array 15a is a laser head including the one-thousand semiconductor laser elements 15a1 arrayed in a line. As illustrated in FIG. 3, the semiconductor laser elements 15a1 are arrayed at an array pitch k of 0.3 (mm). The semiconductor laser elements 15a1 used here are those having a wavelength of 780 (nm).

As illustrated in FIGS. 3 and 4, the ceramic substrate 15a6 is provided on a heat sink 15a9. The heat sink 15a9 is made up of ten heatsinks (manufactured by Alpha Company Ltd., UB30-20B) arrayed in a line, each of which is made of aluminum alloy and has a base size of 30 (mm)×30 (mm), a height of 20 (mm), and thermal resistance of 1.6 (° C./W).

As illustrated in FIG. 4, the ceramic substrate 15a6 is provided with a temperature sensor (thermistor) 15a10 for measuring a temperature of the laser array 15a. The temperature sensor 15a10 is provided facing a point where a center of the sheet P passes through, and supplies an output (temperature data) to the driver circuits.

According to the above configuration, the driver circuits (not illustrated) included in the silicon substrates 15a3 drive the respective semiconductor laser elements 15a1. Here, the control device 15e of FIG. 5 controls the driver circuits in accordance with the image data so as to drive the semiconductor laser elements 15a1. In this way, the semiconductor laser elements 15a1 irradiate the non-fixed toner image on the sheet P with the laser beam.

The driver circuits further carry out the following processes. That is, the driver circuits correct voltages to be applied to the semiconductor laser elements 15a1 in accordance with signals supplied from the photodiodes 15a2. The driver circuits further correct these voltages in accordance with the output of the temperature sensor 15a1.

Embodiment 1

In a laser fixing device, a shorter irradiation region crossing time (a time taken by a point on a sheet to cross an irradiation region 15c) is more advantageous for energy efficiency because energy loss due to heat transmission to the sheet is reduced. However, in this case, a temperature difference is large between a top surface of a toner layer and a boundary face (a boundary surface between the sheet and the toner layer), because the top surface (surface temperature) should be heated to a higher temperature. Further, if the irradiation region crossing time is extremely short, then the surface temperature of the toner layer drastically rises depending on an amount of the toner attached to the sheet, and thus the toner aggregates and/or sublimes. As a result, the toner image on the sheet may suffer from a void (white spot), which is a possible cause of image degradation. Thus, a fixing device employing a laser method has been required to prevent the void which is due to the excessively-high surface temperature.

In order to attain the above object, the inventors of the present invention have diligently studied. As a result, the inventors have found that it is possible to prevent the void which is due to the excessively-high surface temperature of the toner layer, by setting a sheet carrying speed Vp and an irradiation region length D of the laser fixing device so that the following Inequality 1 is satisfied:

$$tn \geqq 0.259 \cdot mt^{1.5139} \qquad \text{Inequality 1}$$

In Inequality 1, mt (mg/cm$^2$) represents an amount of toner attached to the sheet P per unit area, and is a maximum possible amount of attached toner in the image forming apparatus 100. Note here that mt must be less than or equal to 1.5. It should be noted that the image forming apparatus 100 is a color printer, and mt of the image forming apparatus 100 is set to a maximum amount of attached toner in a case of color printing.

Further, tn (msec) is equivalent to the irradiation region crossing time, and is found by dividing the irradiation region length D by the sheet carrying speed Vp.

The irradiation region length D (μm) is a length of the irradiation region 15c (a region, on the sheet P, which is irradiated with the laser beam) in the direction in which a sheet is carried.

The sheet carrying speed Vp (mm/sec) is a speed at which a sheet is carried by the sheet carrying device 15b.

The following description discusses a process carried out so as to find Inequality 1 and the reason why the above object is attained by using Inequality 1.

First, the inventors of the present invention carried out, in accordance with a modeled view (FIG. 6) illustrating how a fixing process is carried out in a laser fixing method, one-dimensional simulation of heat transmission in the fixing process. This heat transmission simulation was carried out for cases where the amount of toner attached to the sheet P per unit area was 0.4 mg/cm$^2$, 0.7 mg/cm$^2$, 1.0 mg/cm$^2$, and 1.3 mg/cm$^2$. In this way, (i) a necessary energy density for the irradiation region crossing time and (ii) a necessary total output power for the irradiation region crossing time were found for each case. (a) through (d) of FIG. 7 illustrate the results.

The necessary energy density is a minimum energy density required in the fixing process. That is, the necessary energy density is a minimum energy density required for raising a temperature of the boundary face between the sheet P and the toner layer up to a melting point of toner. The energy density here is an energy density of the laser beam observed in the irradiation region 15c.

The necessary total output power is a minimum energy amount required in the fixing process. That is, the necessary total output power is a minimum total output power required for raising the temperature of the boundary face between the sheet P and the toner layer up to the melting point of toner. The total output power here is output power of all the semiconductor laser elements 15a1 included in the laser array 15a (for example, the total output power of a laser array including one-thousand semiconductor laser elements of 200 mW is 200 W).

The melting point refers to a temperature at which general and commercially-available toner always melts. The melting point here is set to 118° C. Note however that the melting point is not limited to 118° C., and therefore can be changed as needed depending on a toner to be used.

The results illustrated in (a) through (d) of FIG. 7 show that the necessary energy density and the necessary total output power increase (i) as the amount of the attached toner per unit area (hereinafter referred to merely as "attached-toner amount") increases and/or (ii) as the irradiation region crossing time increases.

Next, the inventors of the present invention calculated how the irradiation region crossing time relates to the surface temperature of the toner layer in a case where the fixing process is carried out in accordance with conditions shown in FIG. 7 (the irradiation region crossing time, the necessary energy density corresponding to the irradiation region crossing time, and the necessary total irradiation time corresponding to the irradiation region crossing time). The calculation was carried out for the cases where the attached-toner amount was 0.4 mg/cm$^2$, 0.7 mg/cm$^2$, 1.0 mg/cm$^2$, and 1.3 mg/cm$^2$. The results are illustrated in (a) through (d) of FIG. 8.

It should be noted here that each of (a) through (d) of FIG. 8 illustrates only a relationship between the irradiation region crossing time and the surface temperature of the toner layer observed when the fixing process was carried out. The necessary energy density and the necessary total output power observed when the fixing process was carried out are not illustrated. For example in (a) of FIG. 8, a plotted point a indicates a surface temperature of the toner layer observed when the fixing process was carried out in accordance with the necessary energy density indicated by a plotted point a' in (a) of FIG. 7 and the necessary total output power indicated by a plotted point a" in (a) of FIG. 7. Further, a plotted point b in (a) of FIG. 8 indicates a surface temperature of the toner layer observed when the fixing process was carried out in accordance with the necessary energy density indicated by a plotted point b' in (a) of FIG. 7 and the necessary total output power indicated by a plotted point b" in (a) of FIG. 7.

Figure 6:
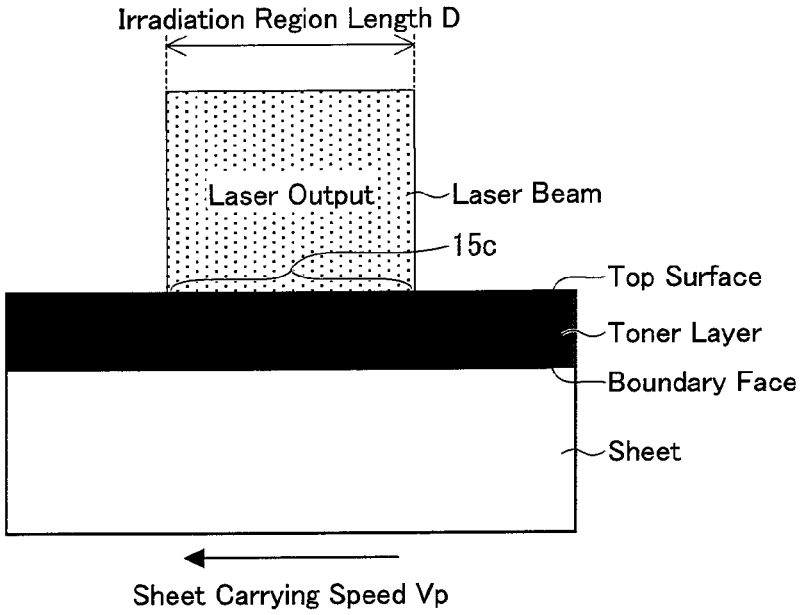
FIG. 6

The surface temperature of the toner layer refers to a temperature of a surface of a toner layer provided on the sheet P (see FIG. 6). In other words, the surface temperature of the toner layer refers to a temperature of a surface, of the toner layer, which is irradiated with the laser beam.

The results illustrated in (a) through (d) of FIG. 8 show that the surface temperature of the toner layer (i) rises as the irradiation region crossing time becomes short, and (ii) drops as the irradiation region crossing time becomes long. According to FIG. 8, the surface temperature of the toner layer can be maintained at approximately 200° C. in a case where the irradiation region crossing time was long, whereas it exceeded 400° C. in a case where the irradiation region crossing time was extremely short. In some cases, the surface temperature of the toner layer reached 600° C.

Meanwhile, commonly-used toner (i.e., toner including binder resin such as styrene acrylic resin or polyester resin) does not sublime at 400° C. or less, whereas it sublimes at a temperature higher than 400° C. This is regardless of type and manufacturer of the commonly-used toner. That is, if the surface temperature of the toner layer exceeds 400° C., then toner of the toner layer may sublime. As a result, an image, made of the toner, formed on the sheet may suffer from a void (white spot). This may lead to image degradation.

In view of this, the inventors of the present invention have calculated, from the results illustrated in (a) through (d) of FIG. 8, what combination of the irradiation region crossing time and the attached-toner amount makes it possible to keep the surface temperature of the toner layer at 400° C. This is specifically described below.

According to the results illustrated in FIG. 8, in order to achieve the surface temperature of the toner layer of 400° C., the irradiation region crossing time and the attached-toner amount should be combined as described in the following Table 1. That is, according to FIG. 8 and Table 1, the surface temperature of the toner layer can be maintained under 400° C. in cases where (i) the attached-toner amount is 0.4 mg/cm$^2$ and the irradiation region crossing time is 0.067 msec or longer, (ii) the attached-toner amount is 0.7 mg/cm$^2$ and the irradiation region crossing time is 0.142 msec or longer, (iii) the attached-toner amount is 1.0 mg/cm$^2$ and the irradiation region crossing time is 0.262 msec or longer, and (iv) the attached-toner amount is 1.3 mg/cm$^2$ and the irradiation region crossing time is 0.393 msec or longer. As such, it is possible to prevent the void which is due to an extremely-high surface temperature of the toner layer.

TABLE 1

| Attached Toner Amount (mg/cm$^2$) | Irradiation Region Crossing Time (msec) |
|---|---|
| 0.4 | 0.067 |
| 0.7 | 0.142 |
| 1.0 | 0.262 |
| 1.3 | 0.393 |

Under the circumstances, a function A, which indicates a relationship between the attached-toner amount and the irradiation region crossing time of Table 1, was found through regression analysis. Then, Inequality 1 was found by using the function A. FIG. 9 illustrates the function A.

$$\text{Irradiation Region Crossing Time} = 0.259 \cdot (\text{Attached-toner Amount})^{1.5139} \qquad \text{Function A}$$

$$tn \geqq 0.259 \cdot mt^{1.5139} \qquad \text{Inequality 1}$$

As a result of the above study, it was found that the surface temperature of the toner layer was maintained under 400° C. by setting the sheet carrying speed Vp and the irradiation region length D (spot diameter) of the fixing device 15 so that Inequality 1 is satisfied. In this way, it is possible to prevent the void from occurring. A total output power of the laser array 15*a* needs to be set to a level greater than or equal to the necessary total output power (refer to FIG. 7) corresponding to a combination of tn and mt. The total output power here is set to the necessary total output power. An energy density of the laser beam needs to be set to an energy density greater than or equal to the necessary energy density (refer to FIG. 7) corresponding to a combination of tn and mt. The energy density here is set to the necessary energy density.

Meanwhile, in a case of a laser fixing device in which the laser beam emitted by a laser source is focused onto a sheet, the spot diameter is approximately 20 μm to 40 μm. However, the spot diameter may need to be greater than 40 μm in a case where tn is set so that Inequality 1 is satisfied. For example, if tn is set to 0.4 msec so that Inequality 1 is surely satisfied in the image forming apparatus in which the maximum attached-toner amount is 1 mg/cm$^2$ and the sheet carrying speed in a case of color printing is 180 mm/sec, then the spot diameter needs to be 72 μm.

In a case where the spot diameter needs to be 40 μm or greater so that Inequality 1 is satisfied, it is only necessary to cause the laser source to directly irradiate the toner layer with the laser beam by omitting a light-focusing optical system which focuses the laser beam to the sheet P. In this way, the spot diameter can be 40 μm or greater so that fixing conditions of the fixing device can be easily set to values which satisfy Inequality 1. For this reason, the fixing device 15 of the present embodiment includes no light-focusing optical system so that the semiconductor laser elements 15*a*1 directly irradiates the sheet P with the laser beam (see FIGS. 2 through 4). Further, the fixing device 15 which includes no light-focusing optical system as illustrated in FIGS. 2 through 4 makes it possible to save energy (approximately 20%), which has been consumed by the light-focusing optical system. Accordingly, the fixing device 15 has an advantage that power is saved.

Embodiment 2

The fixing device including the laser array made up of a plurality of semiconductor laser elements arrayed in a line involves a problem: that is, if a sheet being carried is suddenly stopped due to a trouble (e.g., sheet jam), then the sheet may ignite as a result of part of the sheet being kept irradiated with the laser beam. Taking this into consideration, the fixing device is configured such that laser beam emission is immediately stopped if the sheet being carried is suddenly stopped due to a trouble. In this way, the ignition of the sheet is supposed to be prevented. However, even if the laser beam emission is stopped right after the sheet is suddenly stopped, the temperature of the sheet which has just been stopped may reach an ignition temperature if the irradiation region crossing time is sufficiently short. This is because the temperature of the sheet which has just been stopped is high if the irradiation region crossing time (a time taken by a point on a sheet to cross the irradiation region 15*c*) is short. The sheet ignites when it reaches its ignition temperature. Under the circumstances, the fixing device employing the laser fixing method has been required to prevent ignition even if the sheet having been carried is suddenly stopped due to a trouble.

The inventors of the present invention have diligently studied to attain the above object. As a result, the inventors of the present invention have found that it is possible to prevent the ignition even if the sheet having been carried is suddenly stopped due to a trouble, by setting the sheet carrying speed Vp and the irradiation region length D of the laser fixing device so that Inequality 2 is satisfied:

$$tn \geqq 0.6407 \cdot mt + 0.1459 \qquad \text{Inequality 2}$$

In Inequality 2, mt (mg/cm$^2$) represents an attached-toner amount per unit area on the sheet P. That is, mt is a maximum attached-toner amount possible in the image forming apparatus 100. Note here that mt must be less than or equal to 1.5. It should be noted that the image forming apparatus 100 is a color printer, and mt of the image forming apparatus 100 is set to the maximum attached-toner amount in a case of color printing.

Further, tn (msec) is equivalent to the irradiation region crossing time, and is found by dividing the irradiation region length D by the sheet carrying speed Vp.

The following description discusses a process carried out so as to find Inequality 2 and the reason why the above object is attained by using Inequality 2.

First, the inventors of the present invention calculated how the irradiation region crossing time relates to the temperature of a sheet having just been stopped in a case where a fixing process is carried out in accordance with (i) the irradiation region crossing time and (ii) the necessary energy density and the necessary total output power which correspond to the irradiation region crossing time (see FIG. 7). The calculation was carried out for cases where the attached-toner amount was 0.4 mg/cm$^2$, 0.7 mg/cm$^2$, 1.0 mg/cm$^2$, and 1.3 mg/cm$^2$. The results are illustrated in FIG. 10.

In FIG. 10, a function a indicates a relationship between the irradiation region crossing time and the temperature of a sheet to which the toner of 1.3 mg/cm$^2$ is attached. Assuming that y represents the temperature of the sheet and x represents the irradiation region crossing time, the function a is $y=270.87\times x^{-0.4776}$. A function b indicates a relationship between the irradiation region crossing time and the temperature of a sheet to which the toner of 1.0 mg/cm$^2$ is attached, and is $y=296.39\times x^{-0.4868}$. A function c indicates the relationship between the irradiation region crossing time and the temperature of a sheet to which the toner of 0.7 mg/cm$^2$ is attached, and is $y=230.9\times x^{-0.4589}$. A function d indicates the relationship between the irradiation region crossing time and the temperature of a sheet to which the toner of 0.4 mg/cm$^2$ is attached, and is $y=202.83\times x^{-0.4453}$.

Meanwhile, a sheet which is used commonly in an electrophotographic printer does not ignite as long as it is at 300° C. or lower, regardless of its type and manufacturer (that is, an ignition temperature of a commonly-used sheet is always higher than 300° C.). For example, an ignition test was carried out for the following sheets 1 through 3 to find that none of the sheets 1 thorough 3 ignited at 300° C.

Sheet 1: Copier Paper "Super White" (ASKUL Corporation)

Sheet 2: SJ Paper "PP116JA4" (SHARP DOCUMENT SYSTEMS CORPORATION)

Sheet 3: Full Color Sheet "PP106A4C" (SHARP DOCUMENT SYSTEMS CORPORATION)

Let temperatures at which the sheet does not ignite be referred to as safe temperatures, and an upper limit of the safe temperatures be 300° C. According to the results illustrated in FIG. 10, the irradiation region crossing time and the attached-toner amount should be combined as in Table 2 in order for the temperature of the sheet to be equal to the upper limit of the safe temperatures.

TABLE 2

| Attached Toner Amount (mg/cm$^2$) | Irradiation Region Crossing Time (msec) |
|---|---|
| 0.4 | 0.415 |
| 0.7 | 0.565 |
| 1.0 | 0.807 |
| 1.3 | 0.975 |

According to FIG. 10 and Table 2, a temperature of the sheet which has just been stopped can be maintained within the safe temperatures (i.e., lower than or equal to 300° C.) in cases where (i) the attached-toner amount is 0.4 mg/cm$^2$ and the irradiation region crossing time is 0.415 msec or longer, (ii) the attached-toner amount is 0.7 mg/cm$^2$ and the irradiation region crossing time is 0.565 msec or longer, (iii) the attached-toner amount is 1.0 mg/cm$^2$ and the irradiation region crossing time is 0.807 msec or longer, and (iv) the attached-toner amount is 1.3 mg/cm$^2$ and the irradiation region crossing time is 0.975 msec or longer. As such, it is possible to prevent the ignition of the sheet.

Under the circumstances, a function B, which indicates a relationship between the attached-toner amount and the irradiation region crossing time of Table 2, was found through regression analysis. Then, Inequality 2 was found by using the function B. FIG. 11 illustrates the function B.

$$\text{Irradiation Region Crossing Time} = 0.6407 \cdot (\text{Attached-toner Amount}) + 0.1459 \qquad \text{Function B}$$

$$tn \geqq 0.6407 \cdot mt + 0.1459 \qquad \text{Inequality 2}$$

According to the findings as so far described, the temperature of the sheet which has just been stopped can be maintained within the safe temperatures (i.e., lower than or equal to 300° C.) and thus the sheet can be prevented from igniting, by setting the sheet carrying speed Vp and the irradiation region length D of the fixing device 15 so that Inequality 2 is satisfied. It should be noted here that (i) the total output power of the laser array 15*a* is set to a level greater than or equal to the necessary total output power (refer to FIG. 7) corresponding to a combination of tn and mt, and (ii) an energy density of the laser beam is set to a level greater than or equal to the necessary energy density (refer to FIG. 7) corresponding to a combination of tn and mt.

Further, according to FIG. 11, Inequality 2 is satisfied in a case where a plotted point of tn and mt is in a first region which is positioned downstream, in a Y direction, of a line of the function B. Meanwhile, Inequality 1 found in Embodiment 1 is satisfied in a case where the plotted point of tn and mt is in a second region which is positioned downstream, in the Y direction, of a line of the function A. That is, the plotted point of tn and mt included in the first region is included also in the second region, and thus the image forming apparatus satisfying Inequality 2 also satisfies Inequality 1. As such, the image forming apparatus 100, which is designed so as to satisfy Inequality 2, makes it possible not only to prevent the sheet from igniting but also to prevent the void from occurring.

Embodiment 3

A maximum attached-toner amount in a case of monochromatic printing (i.e., in a case of forming a single color image) is less than the maximum attached-toner amount in a case of color printing (i.e., in a case of forming a multicolor image). Therefore, the void can be prevented also by setting the irradiation region length D and the sheet carrying speed Vp so that the following Inequalities 10 and 11 are satisfied and $tn_2$ is less than $tn_1$ (i.e., $tn_2<tn_1$).

$$tn_1 \geqq 0.259 \cdot mt_1^{1.5139} \quad \text{Inequality 10}$$

$$tn_2 \geqq 0.259 \cdot mt_2^{1.5139} \quad \text{Inequality 11}$$

In Inequality 10, $mt_1$ (mg/cm$^2$) represents an attached-toner amount per unit area on the sheet P. That is, $mt_1$ is a maximum attached-toner amount possible in the image forming apparatus 100 in a case of color printing. Note here that mt must be less than or equal to 1.5.

In Inequality 11, $mt_2$ (mg/cm$^2$) represents a maximum attached-toner amount in a case of monochromatic printing. Note here that $mt_2$ must be less than $mt_1$.

In Inequality 10, $tn_1$ (msec) represents the irradiation region crossing time in the case of color printing. This is found by dividing the irradiation region length D by the sheet carrying speed Vp. In Inequality 11, $tn_2$ (msec) represents the irradiation region crossing time in the case of monochromatic printing. This is found by dividing the irradiation region length D by the sheet carrying speed Vp.

In order to satisfy Inequalities 10 and 11 while satisfying $tn_2<tn_1$, it is only necessary to employ a configuration that at least one of the sheet carrying speed Vp and the irradiation region length D is different between in the case of color printing and in the case of monochromatic printing.

For example, assume that the semiconductor laser elements 15*a*1 of the laser array 15*a* emit the laser beam so that the irradiation region length D is identical in the case of color printing and in the case of monochromatic printing. In order to satisfy $tn_2<tn_1$, the control device 15*e* needs to control the sheet carrying device 15*b* so that the sheet carrying speed Vp is faster in the case of monochromatic printing than in the case of color printing. That is, it is possible to satisfy Inequalities 10 and 11 while satisfying $tn_2<tn_1$ by, for example, (i) setting $mt_1$ to 1 mg/cm$^2$, (ii) setting $mt_2$ to 0.4 mg/cm$^2$ ($mt_1$ is 2.5 times the value of $tm_2$), and (c) setting the sheet carrying speed Vp in the case of monochromatic printing to a value four times the value of the sheet carrying speed Vp in the case of color printing.

Alternatively, Inequalities 10 and 11 and $tn_2<tn_1$ can be satisfied also by carrying out settings so that (i) the sheet carrying speed Vp is identical in the case of monochromatic printing and in the case of color printing and then (ii) the irradiation region length D is shorter in the case of monochromatic printing than in the case of color printing. That is, it is possible to satisfy Inequalities 10 and 11 while satisfying $tn_2<tn_1$ by, for example, (a) setting $mt_1$ to 1 mg/cm$^2$, (b) setting $mt_2$ to 0.4 mg/cm$^2$ ($mt_1$ is 2.5 times the value of $tm_2$), and (c) setting the sheet carrying speed Vp in the case of monochromatic printing to a value ¼ times the value of the sheet carrying speed Vp in the case of color printing.

The following description discusses a fixing device by which the irradiation region length D can be made shorter in the case of monochromatic printing than in the case of color printing.

FIG. 13, showing a first modification of the present embodiment, illustrates a fixing device by which the irradiation region length D can be made shorter in the case of monochromatic printing than in the case of color printing. According to FIG. 13, a fixing device 15' includes a laser array (laser array section) 150*a*, a laser array (laser array section) 151*a*, and a sheet carrying device 15*b*.

The sheet carrying device 15*b* of FIG. 13 has the same configuration as that of FIG. 12. The laser array (second laser array device) 151*a* of FIG. 13 is identical to the laser array 15*a* of FIG. 2. That is, the laser array 151*a* includes a plurality of semiconductor laser elements 15*a*1 arrayed in a line in a predetermined direction (a direction perpendicular to a direction in which a sheet is carried and parallel to a surface of the sheet), and is configured such that the semiconductor laser elements 15*a*1 directly irradiates the sheet P by the laser beam via no light-focusing optical system.

The laser array (first laser array device) 150*a* is provided more upstream in the direction in which the sheet is carried than the laser array 151*a*. The laser array 150*a* is identical to the laser array 15*a* except that the laser array 150*a* includes a light-focusing optical system 20. That is, the laser array 150*a* includes a plurality of semiconductor laser elements 15*a*1 arrayed in the predetermined direction, and is configured such that the laser beam emitted by the semiconductor laser elements 15*a*1 is focused onto the sheet P by the light-focusing optical system 20.

According to the above configuration, the irradiation region length D of the irradiation region of the laser beam emitted from the laser array 150*a* is shorter than the irradiation region length D of the irradiation region of the laser beam emitted from the laser array 151*a* (see FIG. 13).

Meanwhile, the control device 15*e* is configured such that it (i) controls the sheet carrying device 15*b* of FIG. 13 so that the sheet carrying speed is identical in the case of color printing and in the case of monochromatic printing and (ii) activates (a) the laser array 151*a* of FIG. 13 so as to cause the laser array 151*a* to emit the laser beam in the case of color printing and (b) the laser array 150*a* so as to cause the laser array 150*a* to emit the laser beam in the case of monochromatic printing. In this way, it is possible to make the irradiation region length D shorter in the case of monochromatic printing than in the case of color printing so that Inequalities 10 and 11 are satisfied and $tn_2$ is less than $tn_1$.

The following description deals with a fixing device which has a different configuration from that of the fixing device of FIG. 13. FIG. 12, showing a second modification of the present embodiment, illustrates a fixing device by which the irradiation region length D can be made shorter in the case of monochromatic printing than in the case of color printing. According to FIG. 12, a fixing device 15" includes a laser array (laser array section) 152*a* and a sheet carrying device 15*b*.

The sheet carrying device 15*b* of FIG. 13 has the same configuration as that of the sheet carrying device of FIG. 2. The laser array 152*a* is identical to the laser array 15*a*, except that the laser array 152*a* includes a light-focusing optical system 30 and mirrors 31 and 32.

The mirror 31 is controlled by the control device 15*e* so that the mirror 31 is in a position α (indicated by a solid line) in the case of color printing, whereas the mirror 31 is in a position β (indicated by a dotted line) in the case of monochromatic printing. In a case where the mirror 31 is in the position α, the mirror 31 is on a light path of the laser beam emitted from the semiconductor laser elements 15*a*1. Therefore, the mirror 31 reflects the laser beam emitted from the semiconductor laser elements 15*a*1 so that the laser beam travels toward the mirror 32. On the other hand, in a case where the mirror 31 is in the position β, the mirror 31 is outside the light path of the laser beam emitted form the semiconductor laser elements 15*a*1. Therefore, the laser beam is focused to the sheet P via the light-focusing optical system 30.

The mirror 32 reflects the laser beam reflected by the mirror 31 so that the laser beam travels toward the sheet P. That is, in the case where the mirror 31 is in the position α, the laser beam emitted from the semiconductor laser elements 15*a*1 is reflected by the mirrors 31 and 32 so that the laser beam travels to the sheet P via no light-focusing optical system 30.

According to the configuration of FIG. 12, the control device (light path switching section) 15*e* controls the mirror (light path switching section) 31 so that the light path of the laser beam is switched between a first light path and a second light path. The first light path is a light path along which the laser beam travels from the semiconductor laser elements 15*a*1 to the sheet P via no light-focusing optical system 30. The second light path is a light path along which the laser beam travels from the semiconductor laser elements 15*a*1 to the sheet P via the light-focusing optical system 30. The irradiation region length D of the irradiation region of the laser beam having traveled along the second light path is shorter than that of the laser beam having traveled along the first light path. Meanwhile, the control device 15*e* is configured such that it (i) controls the sheet carrying device 15*b* of FIG. 12 so that the sheet carrying speed is identical in the case of color printing and in the case of monochromatic printing and (ii) controls the mirror 31 so that the first light path is selected in the case of color printing whereas the second light path is selected in the case of monochromatic printing. In this way, it is possible to make the irradiation region length D shorter in the case of monochromatic printing than in the case of color printing so that Inequalities 10 and 11 are satisfied and $tn_2$ is less than $tn_1$.

Embodiment 4

The maximum attached-toner amount in the case of monochromatic printing (in a case where a single color image is formed) is less than the maximum attached-toner amount in the case of color printing (in a case where a multicolor image is formed). Therefore, it is possible to prevent both the void and ignition of the sheet also by setting the irradiation region length D and the sheet carrying speed Vp so that the following Inequalities 12 and 13 are satisfied and $tn_2$ is less than $tn_1$.

$$tn_1 \geqq 0.6407 \cdot mt_1 + 0.1459 \quad \text{Inequality 12}$$

$$tn_2 \geqq 0.6407 \cdot mt_2 + 0.1459 \quad \text{Inequality 13}$$

In Inequality 12, $mt_1$ (mg/cm$^2$) represents the attached-toner amount per unit area on the sheet P. That is, $mt_1$ is a maximum attached-toner amount possible in the image forming apparatus 100 in the case of color printing. Note here that $mt_1$ must be less than or equal to 1.5.

In Inequality 13, $mt_2$ (mg/cm$^2$) represents the maximum attached-toner amount in the case of monochromatic printing. Note here that $mt_2$ must be less than $mt_1$.

In Inequality 12, $tn_1$ (msec) represents the irradiation region crossing time in the case of color printing. This is found by dividing the irradiation region length D by the sheet carrying speed Vp. In Inequality 13, $tn_2$ (msec) represents the irradiation region crossing time in the case of monochromatic printing. This is found by dividing the irradiation region length D by the sheet carrying speed Vp.

In order to satisfy Inequalities 12 and 13 and $tn_2 < tn_1$, it is only necessary to employ a configuration that, as in Example 3, (i) the irradiation region length D is identical in the case of monochromatic printing and in the case of color printing and then (ii) the sheet carrying speed Vp is faster in the case of monochromatic printing than in the case of color printing. Alternatively, as in Example 3, Inequalities 12 and 13 and $tn_2 < tn_1$ can be satisfied also by employing a configuration that (a) the sheet carrying speed Vp is identical in the case of monochromatic printing and in the case of color printing and then (b) the irradiation region length D is shorter in the case of monochromatic printing than in the case of color printing. Further, the irradiation region length D can be made shorter in the case of monochromatic printing than in the case of color printing, also by employing the configuration of FIG. 12 or of FIG. 13. This point is also same as Example 3.

In a case of controlling the fixing device so that the irradiation region crossing time is different between in the case of color printing and in the case of monochromatic printing as in Examples 3 and 4, the total output power of the laser array and the energy density are determined in accordance with the maximum attached-toner amount ($mt_1$) and the irradiation region crossing time ($tn_1$) in the case of color printing (see FIG. 7). In this way, it is possible to keep the total output power and the energy density of the laser array higher than or equal to a minimum necessary level both in the case of color printing and in the case of monochromatic printing.

Alternatively, it is also possible to employ a configuration that the total output power and the energy density of the laser array are different between in the case of color printing and in the case of monochromatic printing so that conditions shown in FIG. 7 are satisfied. This configuration can be made by controlling a voltage to be applied to the semiconductor laser elements 15*a*1, or employing pulse-width modulation (PWM).

Overview of Embodiments

An embodiment described earlier is a laser fixing device, which is for use in an electrophotographic image forming apparatus, including: a carrying device for carrying a sheet; and a laser array section which is made up of a plurality of laser sources arrayed across a direction in which the sheet is carried, the plurality of laser sources irradiating a non-fixed toner image, which is attached to the sheet that is being carried by the carrying device, with a laser beam so that the non-fixed toner image is fused and fixed to the sheet, wherein, $$tn \geqq 0.259 \cdot mt^{1.5139},$$

where mt is a maximum level of an attached-toner amount per unit area of the sheet (mg/cm$^2$) in the image forming apparatus, and tn is an irradiation region crossing time (msec), which is found by dividing an irradiation region length by a sheet carrying speed, the irradiation region length being a length, in the direction in which the sheet is carried, of a region on the sheet which region is irradiated with the laser beam, and where mt is less than or equal to 1.5.

According to the laser fixing device designed such that $tn \geqq 0.259 \cdot mt^{1.5139}$ as above, it is possible to prevent the void which is due to the excessively-high surface temperature of the toner layer.

An embodiment described earlier is a laser fixing device, which is for use in an electrophotographic image forming apparatus, including: a carrying device for carrying a sheet; and a laser array section which is made up of a plurality of laser sources arrayed across a direction in which the sheet is carried, the plurality of laser sources irradiating a non-fixed toner image, which is attached to the sheet that is being carried by the carrying device, with a laser beam so that the non-fixed toner image is fused and fixed to the sheet, wherein, $$tn_1 \geqq 0.259 \cdot mt_1^{1.5139},$$

$$tn_2 \geqq 0.259 \cdot mt_2^{1.5139},$$

and $$tn_2 < tn_1,$$

where $mt_1$ is a maximum level of an attached-toner amount per unit area of the sheet ($mg/cm^2$) in the image forming apparatus in a case of multicolor printing, $mt_2$ is a maximum level of an attached-toner amount per unit area of the sheet ($mg/cm^2$) in the image forming apparatus in a case of single color printing, $tn_1$ is an irradiation region crossing time (msec) in the case of multicolor printing, and $tn_2$ (msec) is an irradiation region crossing time (msec) in the case of single color printing, each irradiation region crossing time being found by dividing an irradiation region length by a sheet carrying speed, the irradiation region length being a length, in the direction in which the sheet is carried, of a region on the sheet which region is irradiated with the laser beam, and where $mt_1$ is less than or equal to 1.5, and $mt_2$ is less than $mt_1$.

According to the above laser fixing device designed such that (i) $tn_1 \geqq 0.259 \cdot mt_1^{1.5139}$ in the case of multicolor printing and (ii) $tn_2 \geqq 0.259 \cdot mt_2^{1.5139}$ in the case of single color printing, it is possible to prevent the void which is due to the excessively-high surface temperature of the toner layer. Further, according to the above configuration in which $tn_2$ is less than $tn_1$, a printing speed is faster in the case of single color printing than in the case of multicolor printing. Accordingly, it is possible to improve productivity of the single color printing.

It should be noted that the multicolor printing refers to printing whereby to from an image made up of toner of two or more colors (e.g., full-color image), whereas the single color printing refers to printing whereby to from an image made up of toner of one color (e.g., black-and-white image).

An embodiment described earlier is a laser fixing device, which is for use in an electrophotographic image forming apparatus, including: a carrying device for carrying a sheet; and a laser array section which is made up of a plurality of laser sources arrayed across a direction in which the sheet is carried, the plurality of laser sources irradiating a non-fixed toner image, which is attached to the sheet that is being carried by the carrying device, with a laser beam so that the non-fixed toner image is fused and fixed to the sheet, wherein, $$tn \geqq 0.6407 \cdot mt + 0.1459,$$

where mt is a maximum level of an attached-toner amount per unit area of the sheet ($mg/cm^2$) in the image forming apparatus, and tn is an irradiation region crossing time (msec), which is found by dividing an irradiation region length by a sheet carrying speed, the irradiation region length being a length, in the direction in which the sheet is carried, of a region on the sheet which region is irradiated with the laser beam, and where mt is less than or equal to 1.5.

According to the above laser fixing device designed such that $tn \geqq 0.6407 \cdot mt + 0.1459$, it is possible to prevent the void which is due to the excessively-high surface temperature of the toner layer. Further, according to the laser fixing device designed such that $tn \geqq 0.6407 \cdot mt + 0.1459$, it is possible to prevent ignition of the sheet even if the sheet being carried is suddenly stopped due to a trouble during a fixing process.

An embodiment described earlier is a laser fixing device, which is for use in an electrophotographic image forming apparatus, including: a carrying device for carrying a sheet; and a laser array section which is made up of a plurality of laser sources arrayed across a direction in which the sheet is carried, the plurality of laser sources irradiating a non-fixed toner image, which is attached to the sheet that is being carried by the carrying device, with a laser beam so that the non-fixed toner image is fused and fixed to the sheet, wherein, $$tn_1 \geqq 0.6407 \cdot mt_1 + 0.1459$$

$$tn_2 \geqq 0.6407 \cdot mt_2 + 0.1459,$$

and $$tn_2 < tn_1,$$

where $mt_1$ is a maximum level of an attached-toner amount per unit area of the sheet ($mg/cm^2$) in the image forming apparatus in a case of multicolor printing, $mt_2$ is a maximum level of an attached-toner amount per unit area of the sheet ($mg/cm^2$) in the image forming apparatus in a case of single color printing, $tn_1$ is an irradiation region crossing time (msec) in the case of multicolor printing, and $tn_2$ (msec) is an irradiation region crossing time (msec) in the case of single color printing, each irradiation region crossing time being found by dividing an irradiation region length by a sheet carrying speed, the irradiation region length being a length, in the direction in which the sheet is carried, of a region on the sheet which region is irradiated with the laser beam, and where $mt_1$ is less than or equal to 1.5, and $mt_2$ is less than $mt_1$.

According to the above laser fixing device designed such that (i) $tn_1 \geqq 0.6407 \cdot mt_1 + 0.1459$ in the case of multicolor printing and (ii) $tn_2 \geqq 0.6407 \cdot mt_2 + 0.1459$ in the case of single color printing, it is possible to prevent the void which is due to the excessively-high surface temperature of the toner layer, while preventing ignition of the sheet even if the sheet being carried is suddenly stopped due to a trouble during the fixing process. Further, according to the above configuration in which $tn_2$ is less than $tn_1$, a printing speed is faster in the case of single color printing than in the case of multicolor printing. Accordingly, it is possible to improve productivity of the single color printing.

In addition to the above configuration, the laser fixing device can be a laser fixing device configured such that the laser sources emit the laser beam so that the irradiation region length is identical in the case of multicolor printing and in the case of single color printing, said laser fixing device, further including: a carriage control section which makes $tn_2$ shorter than $tn_1$ by controlling the carrying device so that the sheet carrying speed is faster in the case of single color printing than in the case of multicolor printing.

In addition to the above configuration, the laser fixing device can be a laser fixing device further including: a carriage control section for controlling the carrying device so that the sheet carrying speed is identical in the case of single color printing and in the case of multicolor printing; and a light path switching section for switching between (i) a first light path along which the laser beam travels from the laser array section to the sheet via no light-correcting optical system and (ii) a second light path along which the laser beam travels from the laser array section to the sheet via the light-focusing optical system, the irradiation region length of the irradiation region of the laser beam having traveled along the second light path being shorter than the irradiation region length of the irradiation region of the laser beam having traveled along the first light path, and the light path switching section making $tn_2$ shorter than $tn_1$ by (a) selecting the first light path in the case of multicolor printing and (b) selecting the second light path in the case of single color printing.

In addition to the above configuration, the laser fixing device can be a laser fixing device further including: a carriage control section for controlling the carrying device so that the sheet carrying speed is identical in the case of multicolor printing and in the case of single color printing; and an array control section, the laser array section including: a first laser array device which includes (i) a plurality of laser sources arrayed across the direction in which the sheet is carried and (ii) a light-focusing optical system by which a laser beam emitted from the plurality of laser sources is focused onto the sheet; and a second laser array device which includes a plurality of laser sources arrayed across the direction in which the sheet is carried, and is configured such that the plurality of laser sources irradiates the sheet with the laser beam via no light-focusing optical system, the irradiation region length of the irradiation region of the laser beam emitted from the first laser array device being shorter than the irradiation region length of the irradiation region of the laser beam emitted from the second laser array device, and the array control section making $tn_2$ shorter than $tn_1$ by activating (a) the second laser array device in the case of multicolor printing and (b) the first laser array device in the case of single color printing.

An embodiment described earlier is a method of designing a laser fixing device, which is for use in an electrophotographic image forming apparatus, the laser fixing device including: a carrying device for carrying a sheet; and a laser array section which is made up of a plurality of laser sources arrayed across a direction in which the sheet is carried, the plurality of laser sources irradiating a non-fixed toner image, which is attached to the sheet that is being carried by the carrying device, with a laser beam so that the non-fixed toner image is fused and fixed to the sheet, said method, including: setting an irradiation region length and a sheet carrying speed so that:

$$tn \geqq 0.259 \cdot mt^{1.5139},$$

where mt is a maximum level of an attached-toner amount per unit area of the sheet (mg/cm$^2$) in the image forming apparatus, and tn is an irradiation region crossing time (msec), which is found by dividing the irradiation region length by the sheet carrying speed, the irradiation region length being a length, in the direction in which the sheet is carried, of a region on the sheet which region is irradiated with the laser beam, and where mt is less than or equal to 1.5.

An embodiment described earlier is a method of designing a laser fixing device, which is for use in an electrophotographic image forming apparatus, the laser fixing device including: a carrying device for carrying a sheet; and a laser array section which is made up of a plurality of laser sources arrayed across a direction in which the sheet is carried, the plurality of laser sources irradiating a non-fixed toner image, which is attached to the sheet that is being carried by the carrying device, with a laser beam so that the non-fixed toner image is fused and fixed on the sheet, said method, including: setting an irradiation region length and a sheet carrying speed so that:

$$tn \geqq 0.6407 \cdot mt + 0.1459,$$

where mt is a maximum level of an attached-toner amount per unit area of the sheet (mg/cm$^2$) in the image forming apparatus, and tn is an irradiation region crossing time (msec), which is found by dividing the irradiation region length by the sheet carrying speed, the irradiation region length being a length, in the direction in which the sheet is carried, of a region on the sheet which region is irradiated with the laser beam, and where mt is less than or equal to 1.5.

The laser fixing device is for use in an image forming apparatus. The image forming apparatus may be, for example, a multifunction printer, a copying machine, a printer, and a facsimile apparatus.

The invention is not limited to the description of the embodiments above, but may be altered within the scope of the claims. An embodiment based on a proper combination of technical means disclosed in different embodiments is encompassed in the technical scope of the invention. ps Industrial Applicability The present invention is applicable for use in an electrophotographic image forming apparatus. The electrophotographic image forming apparatus is, for example, a printer, a copying machine, a multifunction printer, and a facsimile apparatus.

REFERENCE SIGNS LIST

15 Fixing Device (Laser Fixing Device)
**15*a*** Laser Array (Laser Array Section)
**15*a*1** Semiconductor Laser Element (Laser Source)
**15*b*** Sheet Carrying Device (Carrying Device)
**15*e*** Control Device (Carriage Control Section, Light Path Switching Section, Array Control Section)
20 Light-focusing Optical System
30 Light-focusing Optical System
31 Mirror (Light Path Switching Section)
100 Image Forming Apparatus
D Irradiation Region Length
P Sheet
**150*a*** Laser Array (First Laser Array Device, Laser Array Section)
**151*a*** Laser Array (Second Laser Array Device, Laser Array Section)
**152*a*** Laser Array (Laser Array Section)

The invention claimed is:

1. A laser fixing device, which is for use in an electrophotographic image forming apparatus comprising a feature to form a monochrome image or a color image, the laser fixing device comprising:

a carrying device for carrying a sheet; and a laser array section which is made up of a plurality of laser sources arrayed across a direction in which the sheet is carried, the plurality of laser sources irradiating a non-fixed toner image, which is attached to the sheet that is being carried by the carrying device, with a laser beam so that the non-fixed toner image is fused and fixed to the sheet, wherein, a sheet carrying speed and an irradiation region length are set so that the following inequality is satisfied $$tn \geqq 0.259 \cdot mt^{1.5139},$$

where mt is a maximum level of an attached-toner amount per unit area of the sheet (mg/cm$^2$) which is determined for the image forming apparatus, and tn is an irradiation region crossing time (msec), which is found by dividing the irradiation region length by the sheet carrying speed, the irradiation region length being a length, in the direction in which the sheet is carried, of a region on the sheet which region is irradiated with the laser beam, and where mt is less than or equal to 1.5.

2. A laser fixing device, which is for use in an electrophotographic image forming apparatus comprising a feature to form a monochrome image and a color image, the laser fixing device comprising:

a carrying device for carrying a sheet; and a laser array section which is made up of a plurality of laser sources arrayed across a direction in which the sheet is carried, the plurality of laser sources irradiating a non-fixed toner image, which is attached to the sheet that is being carried by the carrying device, with a laser beam so that the non-fixed toner image is fused and fixed to the sheet, wherein, a sheet carrying speed and an irradiation region length are set so that the following inequalities are satisfied $$tn_1 \geqq 0.259 \cdot mt_1^{1.5139},$$

$$tn_2 \geqq 0.259 \cdot mt_2^{1.5139},$$

and $$tn_2 < tn_1,$$

where $mt_1$ is a maximum level of an attached-toner amount per unit area of the sheet (mg/cm$^2$) which is determined for the image forming apparatus in a case of multicolor printing, $mt_2$ is a maximum level of an attached-toner amount per unit area of the sheet (mg/cm$^2$) which is determined for the image forming apparatus in a case of single color printing, $tn_1$ is an irradiation region crossing time (msec) in the case of multicolor printing, and $tn_2$ (msec) is an irradiation region crossing time (msec) in the case of single color printing, each irradiation region crossing time being found by dividing the irradiation region length by the sheet carrying speed, the irradiation region length being a length, in the direction in which the sheet is carried, of a region on the sheet which region is irradiated with the laser beam, and where $mt_1$ is less than or equal to 1.5, and $mt_2$ is less than $mt_1$.

3. The laser fixing device according to claim 2, wherein the laser sources emit the laser beam so that the irradiation region length is identical in the case of multicolor printing and in the case of single color printing, said laser fixing device, further comprising:

a carriage control section which makes $tn_2$ shorter than $tn_1$ by controlling the carrying device so that the sheet carrying speed is faster in the case of single color printing than in the case of multicolor printing.

4. The laser fixing device according to claim 2, further comprising:

a carriage control section for controlling the carrying device so that the sheet carrying speed is identical in the case of single color printing and in the case of multicolor printing; and a light path switching section for switching between (i) a first light path along which the laser beam travels from the laser array section to the sheet via no light-correcting optical system and (ii) a second light path along which the laser beam travels from the laser array section to the sheet via the light-focusing optical system, the irradiation region length of the irradiation region of the laser beam having traveled along the second light path being shorter than the irradiation region length of the irradiation region of the laser beam having traveled along the first light path, and the light path switching section making $tn_2$ shorter than $tn_1$ by (a) selecting the first light path in the case of multicolor printing and (b) selecting the second light path in the case of single color printing.

5. The laser fixing device according to claim 2, further comprising:

a carriage control section for controlling the carrying device so that the sheet carrying speed is identical in the case of multicolor printing and in the case of single color printing; and an array control section, the laser array section including:

a first laser array device which includes (i) a plurality of laser sources arrayed across the direction in which the sheet is carried and (ii) a light-focusing optical system by which a laser beam emitted from the plurality of laser sources is focused onto the sheet; and a second laser array device which includes a plurality of laser sources arrayed across the direction in which the sheet is carried, and is configured such that the plurality of laser sources irradiates the sheet with the laser beam via no light-focusing optical system, the irradiation region length of the irradiation region of the laser beam emitted from the first laser array device being shorter than the irradiation region length of the irradiation region of the laser beam emitted from the second laser array device, and the array control section making $tn_2$ shorter than $tn_1$ by activating (a) the second laser array device in the case of multicolor printing and (b) the first laser array device in the case of single color printing.

6. A laser fixing device, which is for use in an electrophotographic image forming apparatus comprising a feature to form a monochrome image or a color image, the laser fixing device comprising:

a carrying device for carrying a sheet; and a laser array section which is made up of a plurality of laser sources arrayed across a direction in which the sheet is carried, the plurality of laser sources irradiating a non-fixed toner image, which is attached to the sheet that is being carried by the carrying device, with a laser beam so that the non-fixed toner image is fused and fixed to the sheet, wherein, a sheet carrying speed and an irradiation region length are set so that the following inequality is satisfied $$tn \geqq 0.6407 \cdot mt + 0.1459,$$

where mt is a maximum level of an attached-toner amount per unit area of the sheet (mg/cm$^2$) which is determined for the image forming apparatus, and tn is an irradiation region crossing time (msec), which is found by dividing the irradiation region length by the sheet carrying speed, the irradiation region length being a length, in the direction in which the sheet is carried, of a region on the sheet which region is irradiated with the laser beam, and where mt is less than or equal to 1.5.

7. A laser fixing device, which is for use in an electrophotographic image forming apparatus comprising a feature to form a monochrome image and a color image, the laser fixing device comprising:

a carrying device for carrying a sheet; and a laser array section which is made up of a plurality of laser sources arrayed across a direction in which the sheet is carried, the plurality of laser sources irradiating a non-fixed toner image, which is attached to the sheet that is being carried by the carrying device, with a laser beam so that the non-fixed toner image is fused and fixed to the sheet, wherein, a sheet carrying speed and an irradiation region length are set so that the following inequalities are satisfied $$tn_1 \geqq 0.6407 \cdot mt_1 + 0.1459$$

$$tn_2 \geqq 0.6407 \cdot mt_2 + 0.1459,$$

and $$tn_2 < tn_1,$$

where $mt_1$ is a maximum level of an attached-toner amount per unit area of the sheet (mg/cm$^2$) which is determined for the image forming apparatus in a case of multicolor printing, $mt_2$ is a maximum level of an attached-toner amount per unit area of the sheet (mg/cm$^2$) which is determined for the image forming apparatus in a case of single color printing, tn1 is an irradiation region crossing time (msec) in the case of multicolor printing, and $tn_2$ (msec) is an irradiation region crossing time (msec) in the case of single color printing, each irradiation region crossing time being found by dividing the irradiation region length by the sheet carrying speed, the irradiation region length being a length, in the direction in which the sheet is carried, of a region on the sheet which region is irradiated with the laser beam, and where $mt_1$ is less than or equal to 1.5, and $mt_2$ is less than $mt_1$.

8. The laser fixing device according to claim 7, wherein the laser sources emit the laser beam so that the irradiation region length is identical in the case of multicolor printing and in the case of single color printing, said laser fixing device, further comprising:

a carriage control section which makes $tn_2$ shorter than $tn_1$ by controlling the carrying device so that the sheet carrying speed is faster in the case of single color printing than in the case of multicolor printing.

9. The laser fixing device according to claim 7, further comprising:

a carriage control section for controlling the carrying device so that the sheet carrying speed is identical in the case of single color printing and in the case of multicolor printing; and a light path switching section for switching between (i) a first light path along which the laser beam travels from the laser array section to the sheet via no light-correcting optical system and (ii) a second light path along which the laser beam travels from the laser array section to the sheet via the light-focusing optical system, the irradiation region length of the irradiation region of the laser beam having traveled along the second light path being shorter than the irradiation region length of the irradiation region of the laser beam having traveled along the first light path, and the light path switching section making $tn_2$ shorter than $tn_1$ by (a) selecting the first light path in the case of multicolor printing and (b) selecting the second light path in the case of single color printing.

10. The laser fixing device according to claim 7, further comprising:

a carriage control section for controlling the carrying device so that the sheet carrying speed is identical in the case of multicolor printing and in the case of single color printing; and an array control section, the laser array section including:

a first laser array device which includes (i) a plurality of laser sources arrayed across the direction in which the sheet is carried and (ii) a light-focusing optical system by which a laser beam emitted from the plurality of laser sources is focused onto the sheet; and a second laser array device which includes a plurality of laser sources arrayed across the direction in which the sheet is carried, and is configured such that the plurality of laser sources irradiates the sheet with the laser beam via no light-focusing optical system, the irradiation region length of the irradiation region of the laser beam emitted from the first laser array device being shorter than the irradiation region length of the irradiation region of the laser beam emitted from the second laser array device, and the array control section making $tn_2$ shorter than $tn_1$ by activating (a) the second laser array device in the case of multicolor printing and (b) the first laser array device in the case of single color printing.

11. A laser fixing device, which is for use in an electrophotographic image forming apparatus, comprising:

a carrying device for carrying a sheet;

a laser array section which is made up of a plurality of laser sources arrayed across a direction in which the sheet is carried;

a carriage control section for controlling the carrying device so that the sheet carrying speed is identical in the case of single color printing and in the case of multicolor printing; and a light path switching section for switching between (i) a first light path along which the laser beam travels from the laser array section to the sheet via no light-correcting optical system and (ii) a second light path along which the laser beam travels from the laser array section to the sheet via the light-focusing optical system, the plurality of laser sources irradiating a non-fixed toner image, which is attached to the sheet that is being carried by the carrying device, with a laser beam so that the non-fixed toner image is fused and fixed to the sheet, wherein, $$tn_1 \geqq 0.259 \cdot mt_1^{1.5139},$$

$$tn_2 \geqq 0.259 \cdot mt_2^{1.5139},$$

and $$tn_2 < tn_1,$$

where $mt_1$ is a maximum level of an attached-toner amount per unit area of the sheet (mg/cm$^2$) in the image forming apparatus in a case of multicolor printing, $mt_2$ is a maximum level of an attached-toner amount per unit area of the sheet (mg/cm$^2$) in the image forming apparatus in a case of single color printing, $tn_1$ is an irradiation region crossing time (msec) in the case of multicolor printing, and $tn_2$ (msec) is an irradiation region crossing time (msec) in the case of single color printing, each irradiation region crossing time being found by dividing an irradiation region length by a sheet carrying speed, the irradiation region length being a length, in the direction in which the sheet is carried, of a region on the sheet which region is irradiated with the laser beam, where $mt_1$ is less than or equal to 1.5, and $mt_2$ is less than $mt_1$, the irradiation region length of the irradiation region of the laser beam having traveled along the second light path being shorter than the irradiation region length of the irradiation region of the laser beam having traveled along the first light path, and the light path switching section making $tn_2$ shorter than $tn_1$ by (a) selecting the first light path in the case of multicolor printing and (b) selecting the second light path in the case of single color printing.

12. A laser fixing device, which is for use in an electrophotographic image forming apparatus, comprising:

a carrying device for carrying a sheet;

a laser array section which is made up of a plurality of laser sources arrayed across a direction in which the sheet is carried;

a carriage control section for controlling the carrying device so that the sheet carrying speed is identical in the case of single color printing and in the case of multicolor printing; and a light path switching section for switching between (i) a first light path along which the laser beam travels from the laser array section to the sheet via no light-correcting optical system and (ii) a second light path along which the laser beam travels from the laser array section to the sheet via the light-focusing optical system, the plurality of laser sources irradiating a non-fixed toner image, which is attached to the sheet that is being carried by the carrying device, with a laser beam so that the non-fixed toner image is fused and fixed to the sheet, wherein, $$tn_1 \geqq 0.6407 \cdot mt_1 + 0.1459$$

$$tn_2 \geqq 0.6407 \cdot mt_2 + 0.1459,$$

and $$tn_2 < tn_1,$$

where $mt_1$ is a maximum level of an attached-toner amount per unit area of the sheet ($mg/cm^2$) in the image forming apparatus in a case of multicolor printing, $mt_2$ is a maximum level of an attached-toner amount per unit area of the sheet ($mg/cm^2$) in the image forming apparatus in a case of single color printing, $tn_1$ is an irradiation region crossing time (msec) in the case of multicolor printing, and $tn_2$ (msec) is an irradiation region crossing time (msec) in the case of single color printing, each irradiation region crossing time being found by dividing an irradiation region length by a sheet carrying speed, the irradiation region length being a length, in the direction in which the sheet is carried, of a region on the sheet which region is irradiated with the laser beam, where $mt_1$ is less than or equal to 1.5, and $mt_2$ is less than $mt_1$, the irradiation region length of the irradiation region of the laser beam having traveled along the second light path being shorter than the irradiation region length of the irradiation region of the laser beam having traveled along the first light path, and the light path switching section making $tn_2$ shorter than $tn_1$ by (a) selecting the first light path in the case of multicolor printing and (b) selecting the second light path in the case of single color printing.

* * * * *